United States Patent [19]

Watanabe

[11] Patent Number: 4,690,543

[45] Date of Patent: Sep. 1, 1987

[54] IMAGE FORMING APPARATUS WITH A PLURALITY OF COLORS

[75] Inventor: Junji Watanabe, Yokohama, Japan

[73] Assignee: Kabushiki Kaisha Toshiba, Kawasaki, Japan

[21] Appl. No.: 865,339

[22] Filed: May 21, 1986

[30] Foreign Application Priority Data

May 28, 1985 [JP] Japan ..... 60-114826

[51] Int. Cl.[4] ..... G03G 15/01

[52] U.S. Cl. ..... 355/4; 355/14 D; 355/14 R; 355/7

[58] Field of Search ..... 355/14 D, 14 R, 4, 3 DD, 355/7, 3 R, 32

[56] References Cited

U.S. PATENT DOCUMENTS 4,589,035 5/1986 Yamanishi et al. ..... 355/4

FOREIGN PATENT DOCUMENTS 2163923 3/1986 United Kingdom ..... 355/4

*Primary Examiner*—R. L. Moses

*Attorney, Agent, or Firm*—Oblon, Fisher, Spivak, McClelland, & Maier

[57] ABSTRACT

According to the present invention, for example, there is slidably provided a CCD unit comprising a CCD and a plurality of filters in the light path of a lens block for magnification and reduction of a multicolor image forming apparatus, in which the CCD performs an irradiation scanning operation of an original using the plurality of filters in turn to sense the original image and then convert it into a series of electric signals which are used for color identification, the color identification data thus obtained being used to operate developing units selectively and an erasure array so as to form a multicolor image corresponding to the original.

2 Claims, 51 Drawing Figures

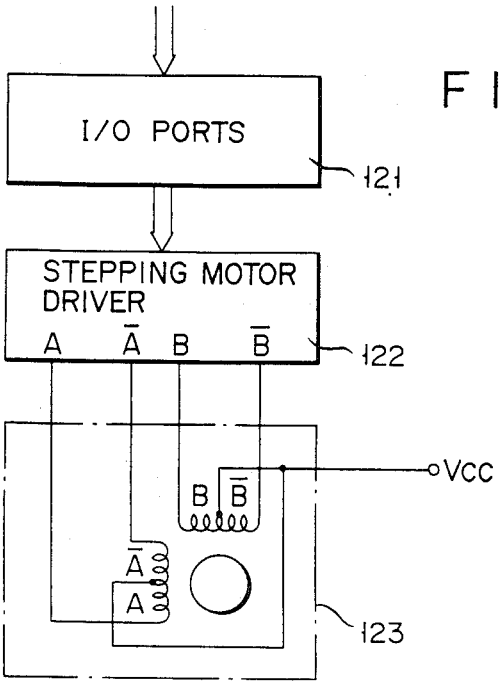
FIG. 11
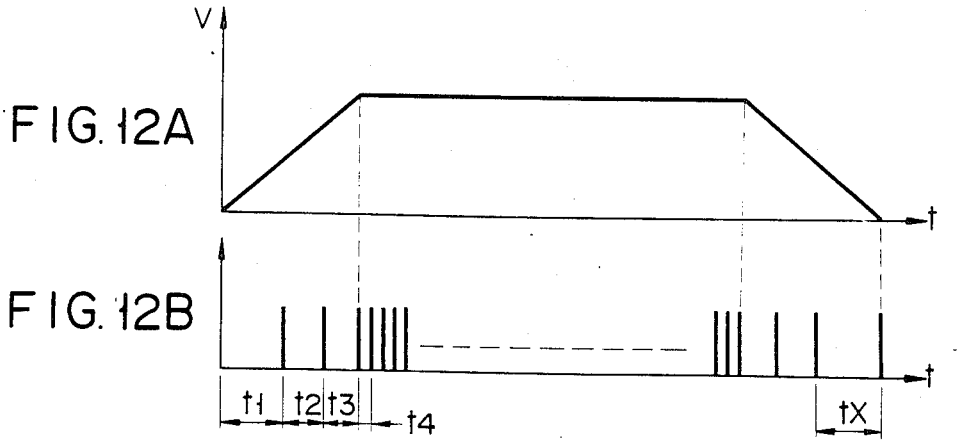
FIG. 12A
FIG. 12B

IMAGE FORMING APPARATUS WITH A PLURALITY OF COLORS

BACKGROUND OF THE INVENTION

This invention relates to an image forming apparatus with a plurality of colors and, more particularly, to an image forming apparatus suitable for an electronic copying machining that can selectively form a multicolor image in response to an original with a plurality of colors.

As well known, a copying machine of any ordinary type can only reproduce a monocolor image even when the original has a plurality of colors. Although a multicolor image forming apparatus that can print-out an image in a plurality of colors in response to a multicolored original image through scanning operation has already been known, an apparatus of this type is generally prohibitively expensive.

SUMMARY OF THE INVENTION

It is therefore an object of the present invention to provide a new and improved image forming apparatus with a plurality of colors that can selectively form a multicolor image in an economical and advantageous manner by using an image forming system for which ordinary developing units can be utilized.

According to the present invention there is provided an image forming apparatus with a plurality of colors, said apparatus comprising:

an original table for placing thereon an original which possesses at least a first color and a second color;

original scanning means for optically scanning an original placed on said original table, said means having an optical system to feed the image reflecting light coming from the original into a given light path;

color component detection means for transmitting electric signals corresponding to said first and second colors in response to the image reflecting light, said means being movably provided on said light path on which said image reflecting light coming from said optical system of said original scanning means passes;

original color identifying means for identifying different color areas from the electric signals for said first and second colors transmitted from said color component detection means and for storing the color and positional data for the first and second colors in different color areas;

image forming means for forming an image of given colors of the original on an image forming medium by using said image reflecting light coming from said optical system of said original scanning means and by selectively driving a first and a second developing units which correspond to said first and second colors respectively;

image erasing means for selectively erasing an image to be formed by said image forming medium;

image forming medium return means for selectively returning said image forming medium to said image forming means after formation of an image by said image forming means;

first control means for producing a first control signal to drive said original scanning means and said color component detection means for a given number of times prior to actual formation of an image;

second control means for reading out, at the time of the first image forming operation, said first color data that have been stored in said original color identifying means to send them to said first developing unit of said image forming means as drive signals and said second positional data which correspond to said second color data to send them to said image erasing means as erasure data and for producing a second control signal to said image forming medium return means as an instruction for a return operation; and third control means for reading out, at the time of the second image forming operation, said second color data that have been stored in said original color identifying means to send them to said second developing unit of said image forming means and said first positional data which correspond to said first color data to send them to said image erasing means as erasure signals.

BRIEF DESCRIPTION OF THE DRAWINGS

These and other objects and features of the present invention can be understood through the following embodiment by reference to the accompanying drawings.

FIGS. 1 to 28 show an embodiment of an image forming apparatus according to the present invention, in which:

FIGS. 1 and 2 are a schematic perspective view and a side sectional view, respectively, showing the construction of the image forming apparatus;

FIG. 3 is a plan view of a control panel;

FIG. 4 is a perspective view showing an arrangement of drive sections;

FIG. 5 is a perspective view schematically showing a drive mechanism for an optical system;

FIG. 6 is a perspective view schematically showing a drive mechanism for indexes;

FIG. 7 is a block diagram showing a general control circuit;

FIG. 8 is a functional block diagram of a main processor group;

FIG. 9 is a functional block diagram of a first sub-processor group;

FIG. 10 is a functional block diagram of a second sub-processor group;

FIG. 11 is a block diagram of a stepping motor control circuit;

FIGS. 12A and 12B are charts for explaining a method of controlling stepping motor speed;

FIG. 13 is a perspective view of the principal part including a spot light source;

FIG. 14 is a side sectional view of the principal part including the spot light source;

FIGS. 15, 16 and 17 are plan views illustrating an operation for specifying the erasure range of the original using the spot light source;

FIGS. 20 and 21 are a perspective view and a front view, respectively, of only the principal part of the erasure array, showing the relationship between the erasure array and a photosensitive drum;

FIG. 23 is a circuit diagram illustrating the configuration of an array drive section;

FIG. 24 is a partially cut-out perspective view of a CCD unit, illustrating the configuration thereof;

FIG. 25 is a perspective view of a filter assembly, illustrating the configuration thereof; and FIGS. 26A, 26B and 26C to 28 are schematic illustrations of the operation of the apparatus; and FIGS. 29 to 43 are a variety illustrations for modified embodiments of the present invention, in which:

FIG. 29 is a perspective view of a first modified embodiment, schematically illustrating the relationship between the indexes and the fixed scale plate as well as the indexes driving mechanism thereof;

FIG. 31 is a graphic illustration of the spectral wavelength characteristics of the photosensitive drum of a second modified embodiment;

FIGS. 32A, 32B and 33 are schematic illustrations showing operation of the second modified embodiment;

FIGS. 34 and 35 are schematic illustrations showing the relationship between the lens block for magnification and reduction and the mirrors of the second modified embodiment;

FIG. 36 is a partial plan view of a third modified embodiment showing the principal section thereof to illustrate a specified erasure area;

FIG. 37 is a flow-chart of the operation of the third modified embodiment;

FIG. 38 is a flow-chart of the operation of a fourth modified embodiment of the present invention;

FIGS. 39 to 40 are schematic views of the fourth embodiment illustrating placement of an original;

FIG. 42 is a perspective view of the fourth modified embodiment illustrating the relationship between the indexes and the fixed scale plates are well as the indexes driving mechanism thereof; and FIG. 43 is a plan view of the fourth modified embodiment illustrating the relationship between the indexes and the original table thereof.

DETAILED DESCRIPTION OF THE PREFERRED EMBODIMENT

Figure 1:
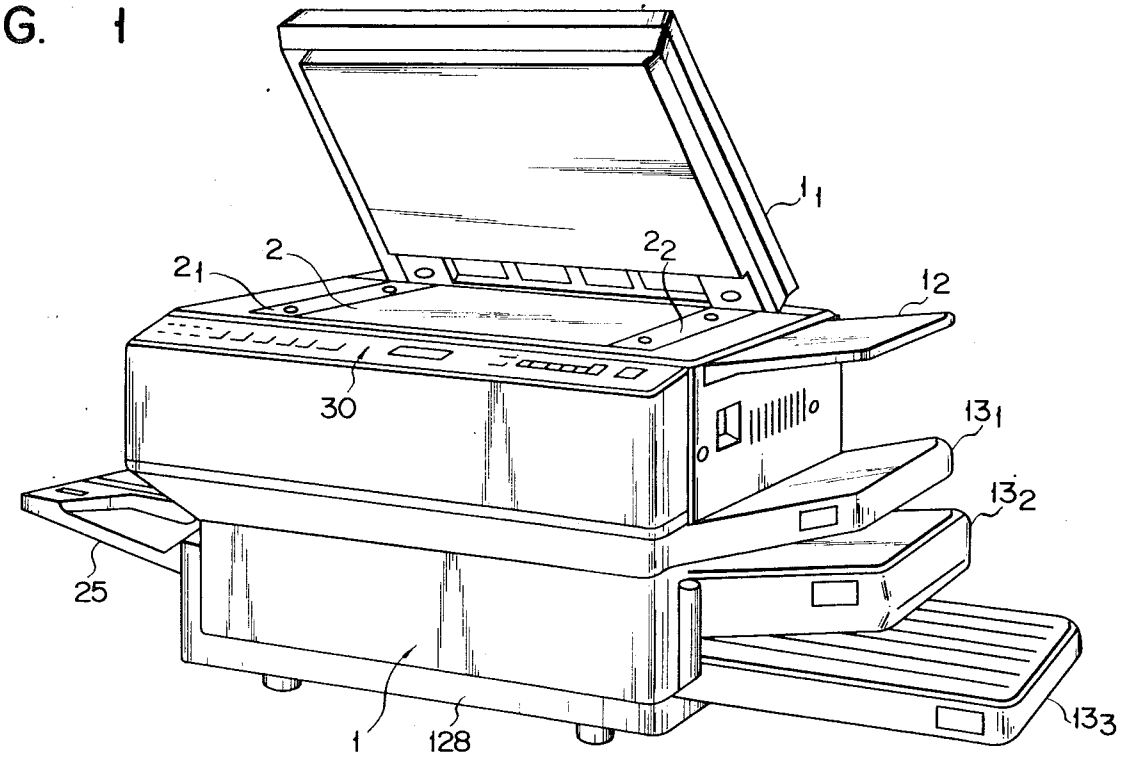
Figure 2:
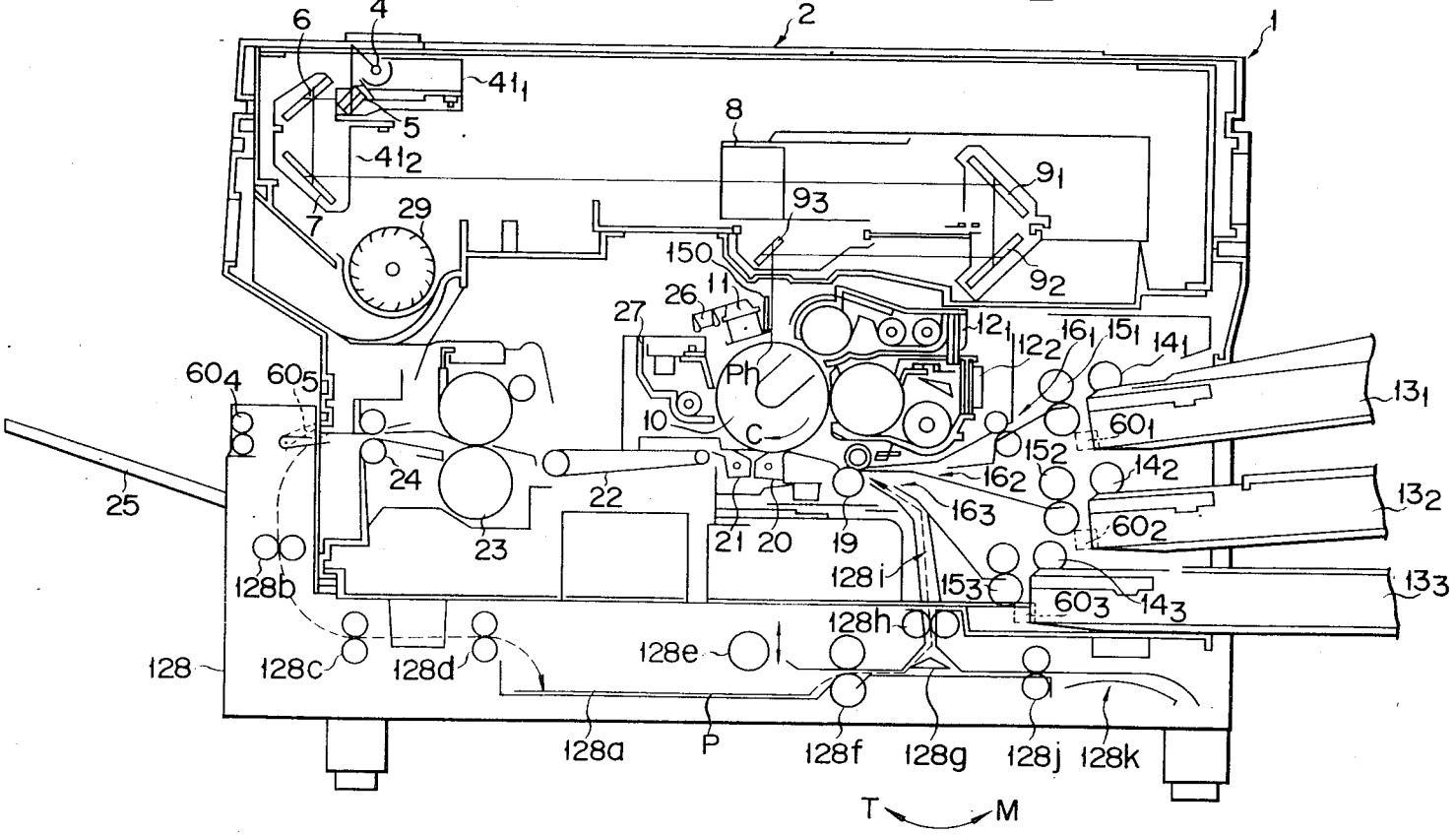

FIGS. 1 and 2 schematically show a copying machine as an image forming apparatus according to an embodiment of the present invention. Reference numeral 1 denotes a copying machine housing. An original table (i.e., a transparent glass) 2 is fixed on the upper surface of the housing 1. An operable original cover $1_1$ and a work table $1_2$ are arranged near the table 2. A first fixed scale $2_1$ and second fixed scale $2_2$ as references for setting an original are arranged at both ends of the table 2 along the longitudinal direction thereof.

The original set on the original table 2 is scanned image exposure as an optical system including an exposure lamp 4 and mirrors 5, 6 and 7 reciprocates in the direction indicated by arrow a along the under surface of the original table 2. In this case, the mirrors 6 and 7 move at a speed half that of the mirror 5 so as to maintain a fixed optical path length.

A reflected light beam from the original scanned by the optical system 3, that is, irradiated by the exposure lamp 4, is reflected by the mirrors 5, 6 and 7, transmitted through a lens block 8 for magnification or reduction, and then reflected by a mirror $9_1$, $9_2$, $9_3$ to be projected on a photosensitive drum 10. Thus, an image of the original is formed on the surface of the photosensitive drum 10.

The photosensitive drum 10 rotates in the direction indicated by arrow c so that its surface is wholly charged first by a main charger 11.

The latent image formed on drum 10 is applied with red or black toner by developing units $12_1$ and $12_2$, which are selectively operated so that the latent image can be produced as a visible image. Meanwhile, sheets (image forming media) P are selectively fed by feed rollers $14_1$, $14_2$ and $14_3$ and roller pairs $15_1$, $15_2$ and $15_3$ from upper, middle and lower cassettes $13_1$, $13_2$ and $13_3$ one by one. Each sheet is guided to aligning roller pair 19 along guide path $16_1$, $16_2$ and $16_3$ and is fed by pair 19 to the transfer section. It should be noted that cassettes $13_1$, $13_2$ and $13_3$ are detachably attached to the lower portion at the right side of housing 1. One of the cassettes must be selected at the operation panel (to be described later). Sizes of cassettes $13_1$, $13_2$ and $13_3$ are detected by cassette size detection switch $60_1$, $60_2$ and $60_3$, respectively. Switches $60_1$, $60_2$ and $60_3$ comprise a plurality of microswitches which are turned on/off upon the insertion of cassettes of different sizes.

The paper sheet P delivered to the transfer region comes into intimate contact with the surface of the photosensitive drum 10, in the space between a transfer charger 20 and the drum 10. As a result, the toner image on the photosensitive drum 10 is transferred to the paper sheet P by the agency of the charger 20. After the transfer, the paper sheet P is separated from the photosensitive drum 10 by a separation charger 21 and transported by a conveyor belt 22. Thus, the paper sheet P is delivered to a fixing roller pair 23 as a fixing unit arranged at the terminal end portion of the conveyor belt 22. As the paper sheet P passes through the fixing roller pair 23, the transferred image fixed on the sheet P. After the fixation, the paper sheet P is discharged into a tray 25 outside the housing 1 by two exit roller pairs 24, $60_4$.

After the transfer, moreover, the photosensitive drum 10 is de-electrified by a de-electrification charger 26, when the residual toner on the surface of the drum 10 is removed by a cleaner 27. Thereafter, a residual image on the photosensitive drum 10 is erased by a discharge lamp 28 to restore the initial state. In FIG. 2, numeral 29 designates a cooling fan for preventing the temperature inside the housing 1 from rising.

Two-side multicopying unit 128 is arranged at the lower portion of housing 1 to perform two-side copying or multicopying for copying different images on the same sheet surface. Unit 128 has selection gate $60_5$, discharge roller pair $60_4$, and a plurality of roller pairs 128*b*, 128*c* and 128*d* for guiding the sheet from gate $60_5$ to stacking portion 128*a*. Feedout roller 128*e* is arranged in portion 128*a* to feed out the sheets temporarily stacked in portion 128*a*. Roller 128*e* can be moved vertically in the direction of the arrow in accordance with the thickness (number) of stacked sheets. The sheets fed by roller 128*e* are separated by separation roller pair 128*f* one by one, and each sheet is guided to control gate 128*g*. Gate 128*g* is pivoted in the M direction when multicopying is performed, so that the sheet is guided to roller pair 19 through convey roller pair 128*h* along sheet guide path 128*i*. However, when time-side copying is performed, gate 128*g* is set to the position illustrated in FIG. 30, so that the sheet is guided to inverting portion 128*k* through roller pair 128*j*. When the sheet is fed to portion 128*k*, gate 128*g* is pivoted in the T direction, so that it is guided to pair 19 through pair 128*h* along path 128*i*.

Incidentally, in this example, control gate 128*g* is kept as turned to the direction indicated by arrow M so that only multiple copying is possible.

Figure 3:
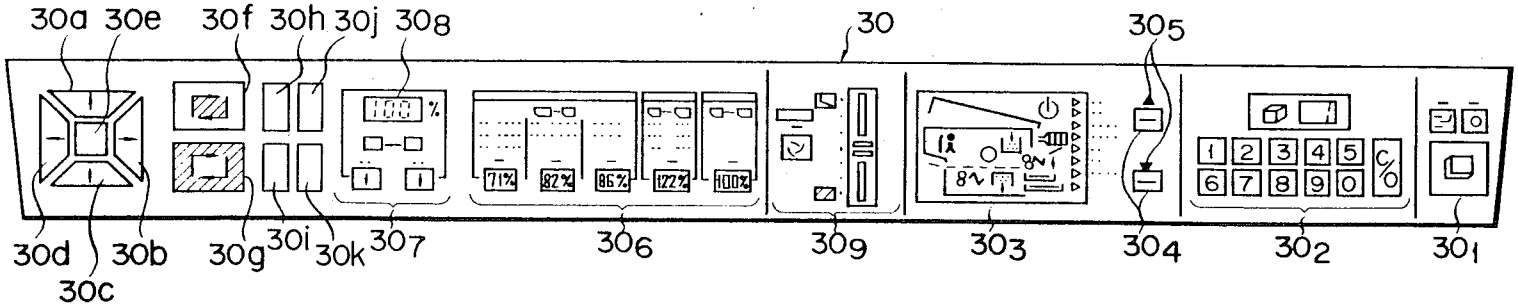

FIG. 3 shows a control panel 30 mounted on the housing 1. The control panel 30 carries thereon a copy key $30_1$ for starting the copying operation, ten-keys $30_2$ for setting the number of copies to be made and the like, a display section $30_3$ for indicating the operating conditions of the individual parts or paper jamming, cassette selection keys $30_4$ for alternatively selecting the upper or median or lower paper cassette $13_1$ or $13_2$ or $13_3$, and cassette display sections $30_5$ for indicating the selected cassette. The control panel 30 is further provided with ratio setting keys $30_6$ for setting the enlargement or reduction ratio of copy selected among several predetermined ratios, zoom keys $30_7$ for adjustably setting the enlargement or reduction ratio, a display section $30_8$ for displaying the set ratio, and a density setting section $30_9$ for setting the copy density. Additionally arranged on the control panel 30 are operation keys 30*a*, 30*b*, 30*c* and 30*d* for shifting a spot light source (mentioned later) which serves to indicate as erasure area an unnecessary portion of the original, a position designating key 30*e* for inputting the coordinate positions indicated by the spot light source, and erasure range designating keys 30*f* and 30*g* for designating the erasure ranges in the designated positions.

Reference numerals 30*h*, 30*i*, 30*j* and 30*k* designate a black and white copying specifying key, a color copying specifying key, a red specifying key to specify a developing unit $12_1$, for example, in which red toner is contained and a black specifying key to specify a developing unit $12_2$, for example, in which black toner is contained.

Figure 4:
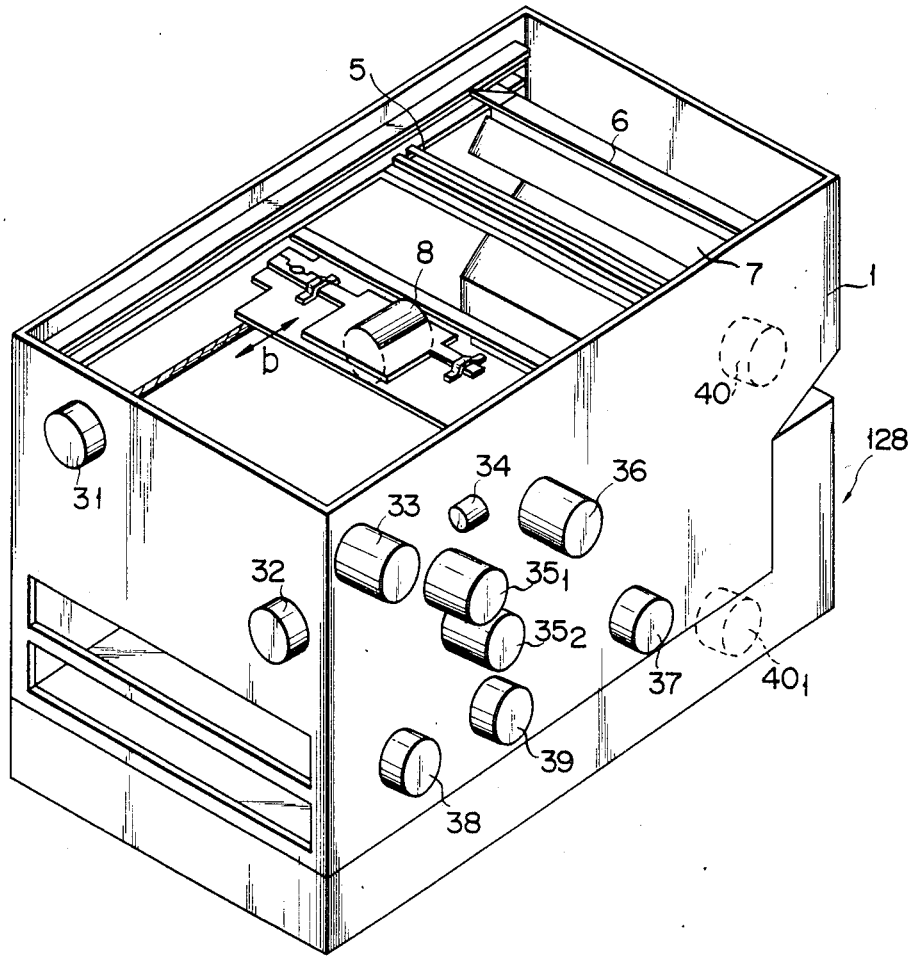

FIG. 4 shows a specific arrangement of drive sources for individual drive sections of the copying machine constructed in the aforesaid manner. The drive sources include the following motors. Numeral 31 designates a motor for lens drive. The lens drive motor 31 serves to shift the position of the lens block 8 for magnification or reduction. Numeral 32 designates a motor for mirror drive. The mirror drive motor 32 serves to change the distance (optical path length) between the mirror 5 and the mirrors 6 and 7 for magnification or reduction. Numeral 33 designates a stepping motor for scanning. The stepping motor 33 serves to move the exposure lamp 4 and the mirrors 5, 6 and 7 for scanning the original. Numeral 34 designates a motor for shutter drive. The shutter drive motor 34 serves to move a shutter (not shown) for adjusting the width of charging of the photosensitive drum 10 by the charger 11 at the time of magnification or reduction.

Numerals $35_1$ and $35_2$ designate motors used for developing. The developing motors $35_1$ and $35_2$ serve to drive the developing roller and the like of the developing units $12_1$ and $12_2$. Numeral 36 designates a motor used to drive the drum. The drum drive motor 36 serves to drive the photosensitive drum 10. Numeral 37 designates a motor for fixation. The fixing motor 37 serves to drive the sheet conveyor belt 22, the fixing roller pair 23, and the exit roller pair $60_4$. Numeral 38 designates a motor for paper supply. The paper supply motor 38 serves to drive the paper-supply rollers $14_1$, $14_2$ and $14_3$. Numeral 39 designates a motor for feeding sheets. The sheet feed motor 39 serves to drive the aligning roller pair 19. Numeral 40 designates a motor for fan drive. The fan drive motor 40 serves to drive the cooling fan 29. Numeral $40_1$, a motor for driving roller pairs 128*a* to 128*d*, etc. and feed roller 128*e*.

Figure 5:
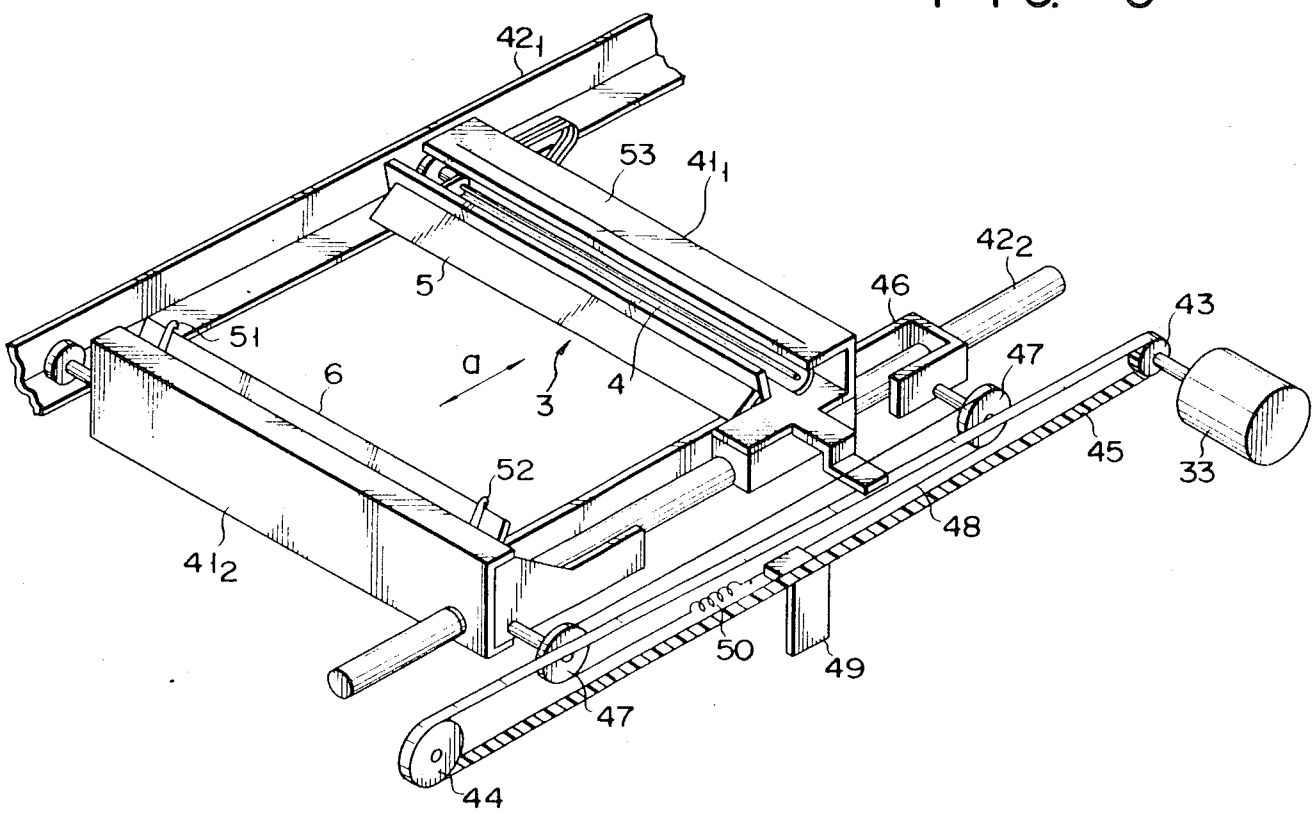

FIG. 5 shows a drive mechanism for reciprocating the optical system. The mirror 5 and the exposure lamp 4 are supported by a first carriage $41_1$, and the mirrors 6 and 7 by a second carriage $41_2$. These carriages $41_1$ and $41_2$ can move parallel in the direction indicated by arrow a, guided by guide rails $42_1$ and $42_2$. The four-phase stepping motor 33 drives a pulley 43. An endless belt 45 is stretched between the pulley 43 and an idle pulley 44, and one end of the first carriage $41_1$ supporting the mirror 5 is fixed to the middle portion of the belt 45.

On the other hand, two pulleys 47 are rotatably attached to a guide portion 46 (for the rail $42_2$) of the second carriage $41_2$ supporting the mirrors 6 and 7, spaced in the axial direction of the rail $42_2$. A wire 48 is stretched between the two pulleys 47. One end of the wire 48 is connected directly to a fixed portion 49, while the other end is connected thereto by means of a coil spring 50. The one end of the first carriage $41_1$ is fixed to the middle portion of the wire 48.

With this arrangement, when the stepping motor 33 is driven, the belt 45 turns around to move the first carriage $41_1$. As the first carriage $41_1$ travels, the second carriage $41_2$ also travels. Since the pulleys 47 then serve as movable pulleys, the second carriage $41_2$ travels in the same direction as and at a speed half that of the first carriage $41_1$. The traveling direction of the first and second carriages $41_1$ and $41_2$ is controlled by changing the rotating direction of the stepping motor 33.

The original table 2 carries thereon an indication of a reproducible range corresponding to the size of designated paper sheets. If the sheet size designated by the sheet selection keys $30_4$ and the copy ratio specified by the ratio setting keys $30_6$ or $30_7$ are (Px, Py) and K, respectively, the reproducible range (x, y) is given by $$x = Px/K,$$
$$y = Py/K.$$

Out of the coordinates (x, y) designating any point within the reproducible range, as shown in FIG. 1, the x coordinate is indicated by indexes 51 and 52 arranged on the inside of the original table 2, and the y coordinate by a scale 53 provided on the top face portion of the first carriage $41_1$.

Figure 6:
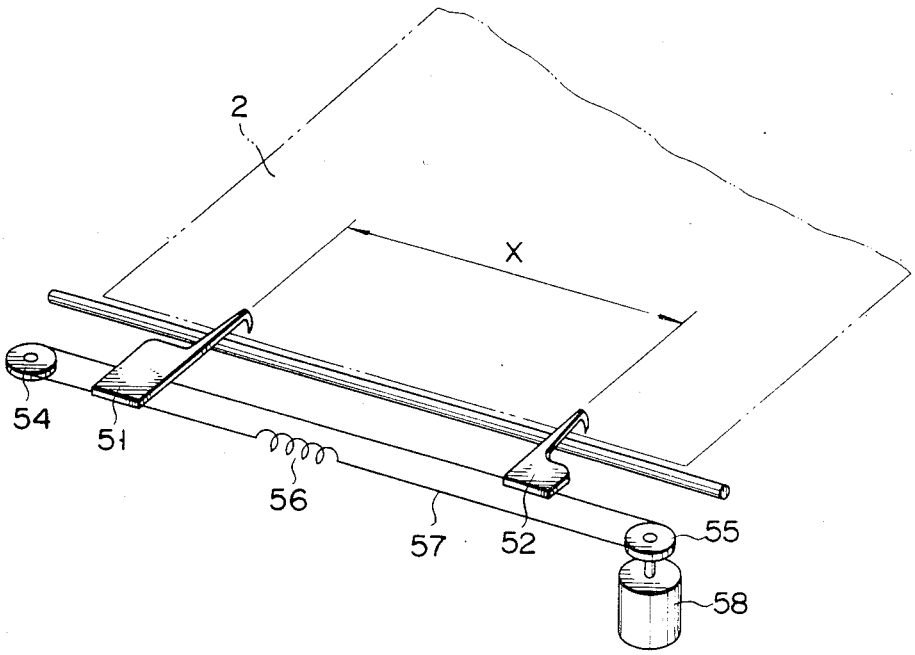

As shown in FIG. 6, the indexes 51 and 52 are attached to a wire 57 which is stretched between pulleys 54 and 55 through the aid of a spring 56. The pulley 55 is rotated by a motor 58. The distance between the indexes 51 and 52 can be changed by driving the motor 58 in accordance with the sheet size and the enlargement or reduction ratio.

The first carriage $41_1$ moves to a predetermined position (home position depending on the enlargement or reduction ratio) as the motor 33 is driven in accordance with the sheet size and the ratio. When the copy key $30_1$ is depressed, the first carriage $41_1$ is first moved toward the second carriage $41_2$. The, lamp 4 is lighted and the first carriage $41_1$ is moved away from the second carriage $41_2$. When the original scanning ends, the lamp 4 is turned off, and the first carriage $41_1$ is returned to the home position.

Figure 7:
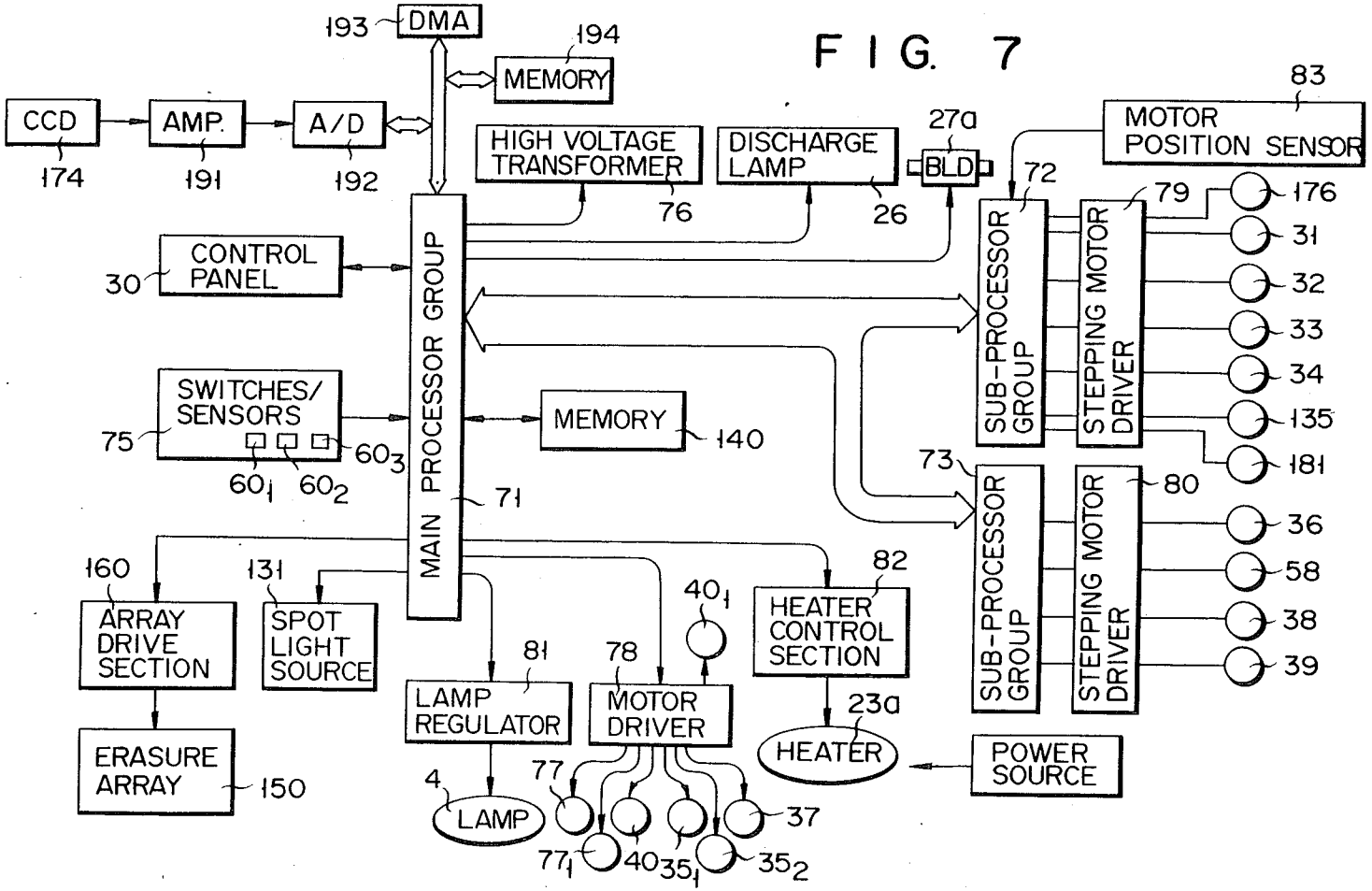

FIG. 7 shows a general control circuit of the electronic copying machine. This control circuit is mainly composed of a main processor group 71 and first and second sub-processor groups 72 and 73. The main processor group 71 detects input data from the control panel 30 and a group of input devices 75 including various switches and sensors, such as the cassette size detection switches $60_1$, $60_2$ and $60_3$ and controls a high-voltage transformer 76 for driving the chargers, the discharge lamp 28, a blade solenoid 27*a* of the cleaner 27, a heater 23*a* of the fixing roller pair 23, the exposure lamp 4, and the motors 31 to 40 and 58, thus accomplishing the copying operation. The main processor group 71 also controls a spot light source 131, a stepping motor 135, an erasure array 150, an array drive section 160, and a memory 140, thereby erasing any unnecessary portions of the original. These components 131, 135, 150 and 140 will be described in detail later.

Additionally they operate to control motors 176 and 181, CCD 174, amplifier 191, A/D converter 192, DMA (direct memory access unit) 193 and memory 194 to identify the colors of an original. Spot light source 131, pulse motor 135, erasure array 150, array driving unit 160, memory 140, pulse motors 176 and 181, CCD 174, amplifier 191, A/D converter 192, DMA 193 and memory 194 will be described later.

The motors $35_1$, $35_2$, 37, 40, and $40_1$ and tonersupply motors 77, $77_1$ for supplying the toner to the developing units $12_1$ and $12_2$ are connected through a motor driver 78 to the main processor group 71 to be controlled thereby. The motors 31 to 34, 135, 176 and 181 are connected through a stepping motor driver 79 to the first sub-processor group 72 to be controlled thereby. The motors 36, 38, 39 and 58 are connected through a stepping motor driver 80 to the second sub-processor group 73 to be controlled thereby.

Further, the exposure lamp 4 is controlled by the main processor group 71 through a lamp regulator 81, and the heater 23*a* by the main processor group 71 through a heater control section 82. The main processor group 71 gives instructions for the start or stop of the individual motors to the first and second sub-processor groups 72 and 73. Thereupon, the first and second sub-processor groups 72 and 73 feed the main processor group 17 with status signals indicative of the operation mode of the motors. Also, the first subprocessor group 72 is supplied with positional information from a position sensor 83 for detecting the respective initial positions of the motors 31 to 34, 135, 176 and 181.

Figure 8:
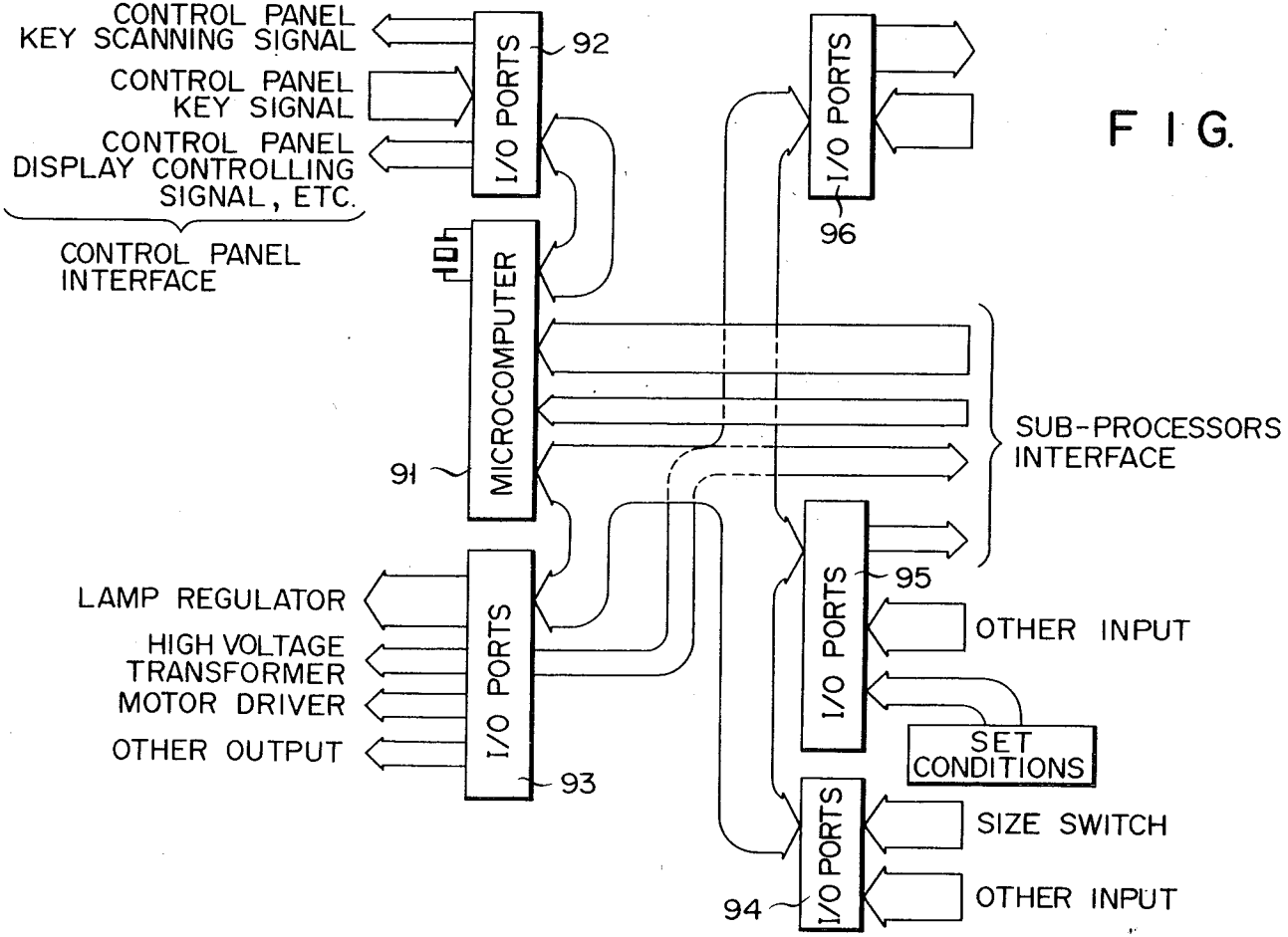

FIG. 8 shows an arrangement of the main processor group 71. Reference numeral 91 denotes a one-chip microcomputer (to be referred to as a CPU hereinafter). The CPU 91 detects key inputs at a control panel (not shown) through an I/O port 92 and controls display operations. The CPU 91 can be expanded through I/O ports 93 to 96. The port 93 is connected to a high-voltage transformer 76, a motor driver 78, a lamp regulator 81 and other outputs. The port 94 is connected to a size switch for detecting a paper size and other inputs. The port 95 is connected to a copying condition setting switch and other inputs. The port 96 is optional.

Figure 9:
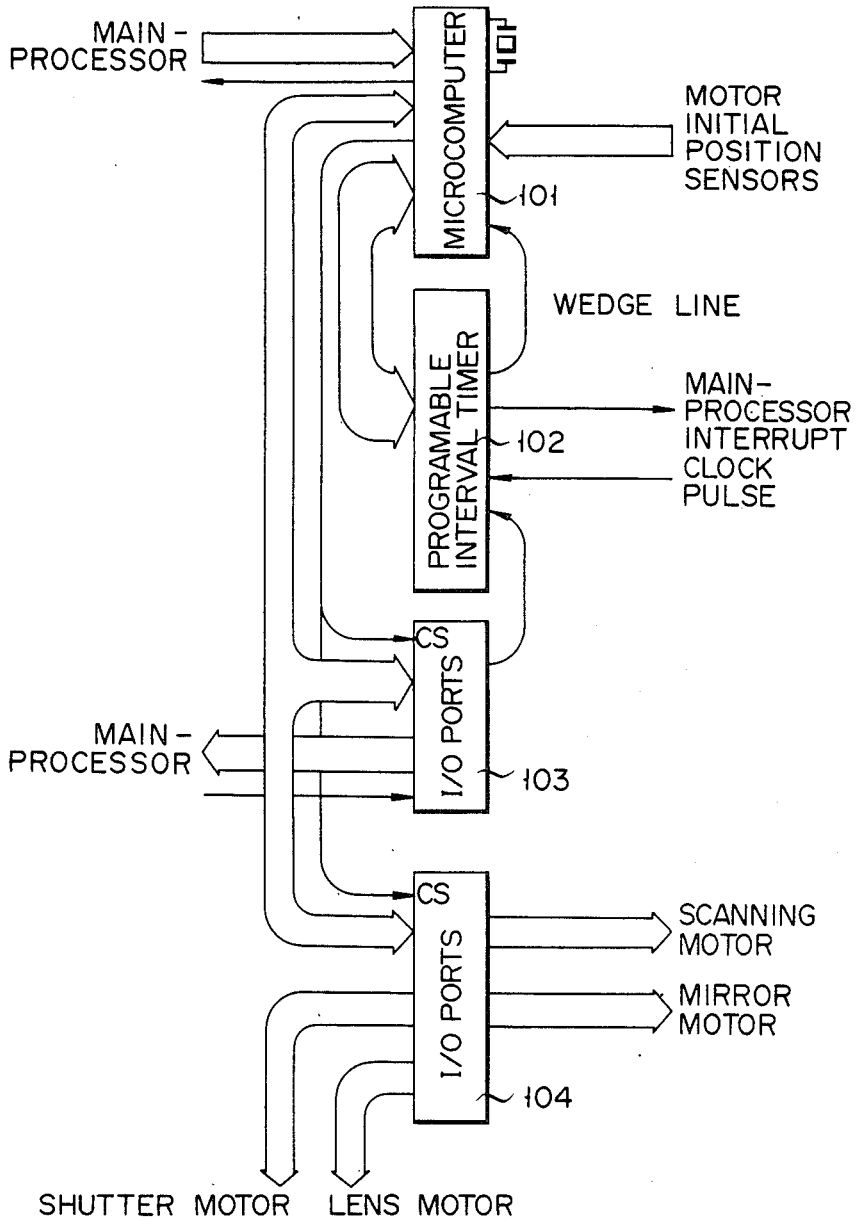

FIG. 9 shows an arrangement of the first subprocessor group 72. Reference numeral 101 denotes a CPU connected to the group 71. Reference numeral 102 denotes a programmable interval timer for controlling switching time intervals. A preset value from the CPU 101 is set in the programmable interval timer, and the timer is started. When the timer is stopped, the timer sends an end pulse onto an interrupt line of the CPU 101. The timer 102 receives a reference clock pulse. The CPU 101 receives position data from a position sensor 83 and is connected to I/O ports 103 and 104. The port 104 is connected to motors 31 to 34, 176 and 181 through the stepping motor driver 79. The port 103 is used to supply a status signal from each stepping motor to the group 71.

Figure 10:
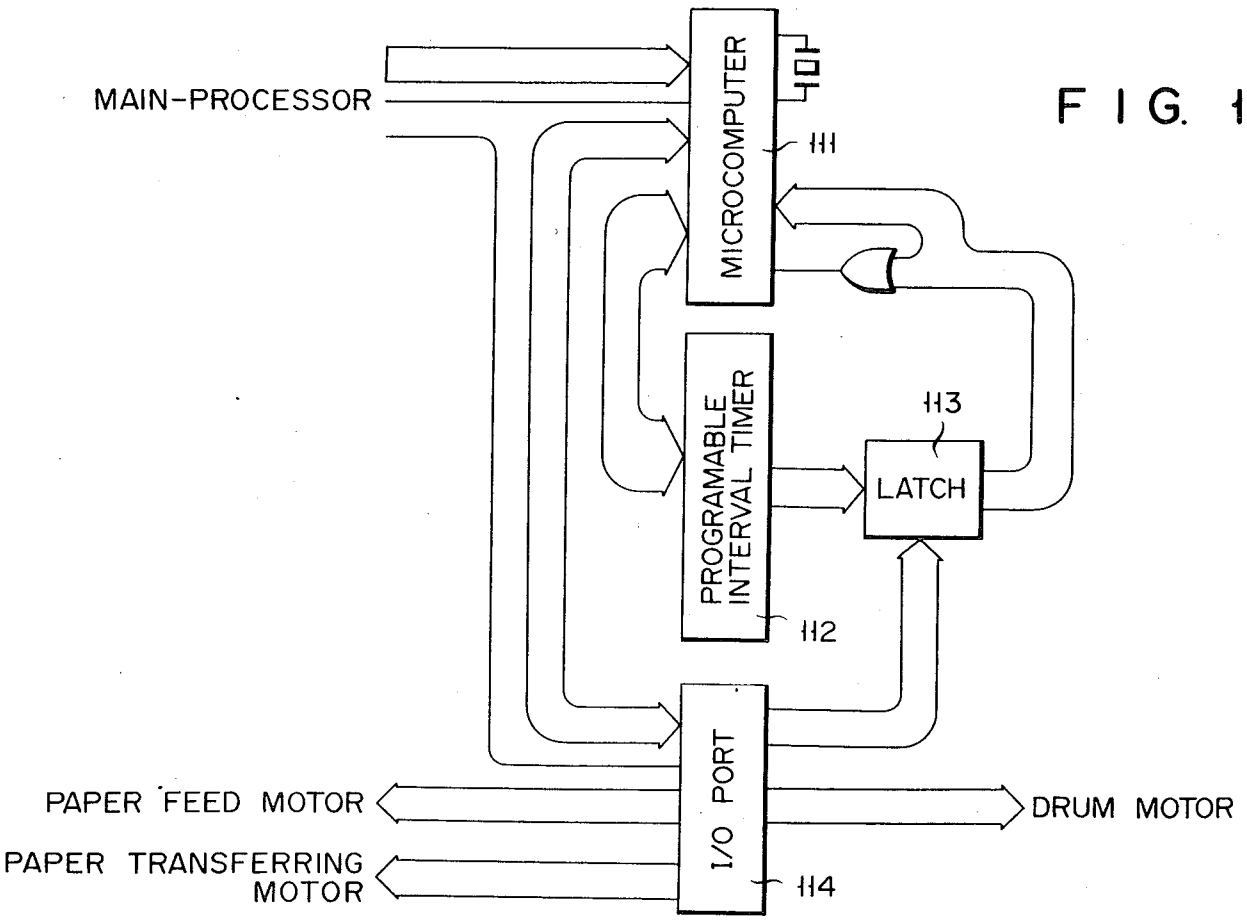

FIG. 10 shows an arrangement of the second subprocessor group 73. Reference numeral 111 denotes a CPU connected to the group 71. Reference numeral 112 denotes a programmable interval timer for controlling switching time intervals of the pulse motors. A preset value from the CPU 111 is set in the programmable interval timer, and the timer is started. When the timer is stopped, it generates an end pulse. The end pulse is latched by a latch 113, and an output therefrom is supplied onto the interrupt line of the CPU 111 and the input line of the I/O port. The CPU 111 is connected to an I/O port 114 which is then connected to motors 36, 38, 39 and 58 through the driver 80.

FIG. 11 shows a stepping motor control circuit. An I/O port 121 (corresponding to the ports 104 and 114 of FIGS. 9 and 10) is connected to a stepping motor driver 122 (corresponding to the drivers 79 and 80 of FIG. 7). The driver 122 is connected to windings A, $\overline{A}$, B and $\overline{B}$ of a stepping motor 123 (corresponding to the motors 31 to 34, 36, 38, 39, 58, 135, 176 and 181.

FIGS. 12A and 12B show a method of controlling a stepping motor speed. FIG. 12A shows a stepping motor speed curve, and FIG. 12B shows switching intervals. As is apparent from FIGS. 12A and 12B, the switching intervals are long at the beginning, are gradually decreased, and finally stop to decrease. Then, the intervals are prolonged, and the stepping motor is finally stopped. This cycle indicates the through-up and through-down of the pulse motor. The motor is started from the self starting region, operated in a high-speed region and is gradually stopped. Reference symbols $t_1$, $t_2$, . . . $t_x$ denote times between the switching intervals.

Indicating means and erasing means according to the present invention will now be described in detail.

Figure 13:
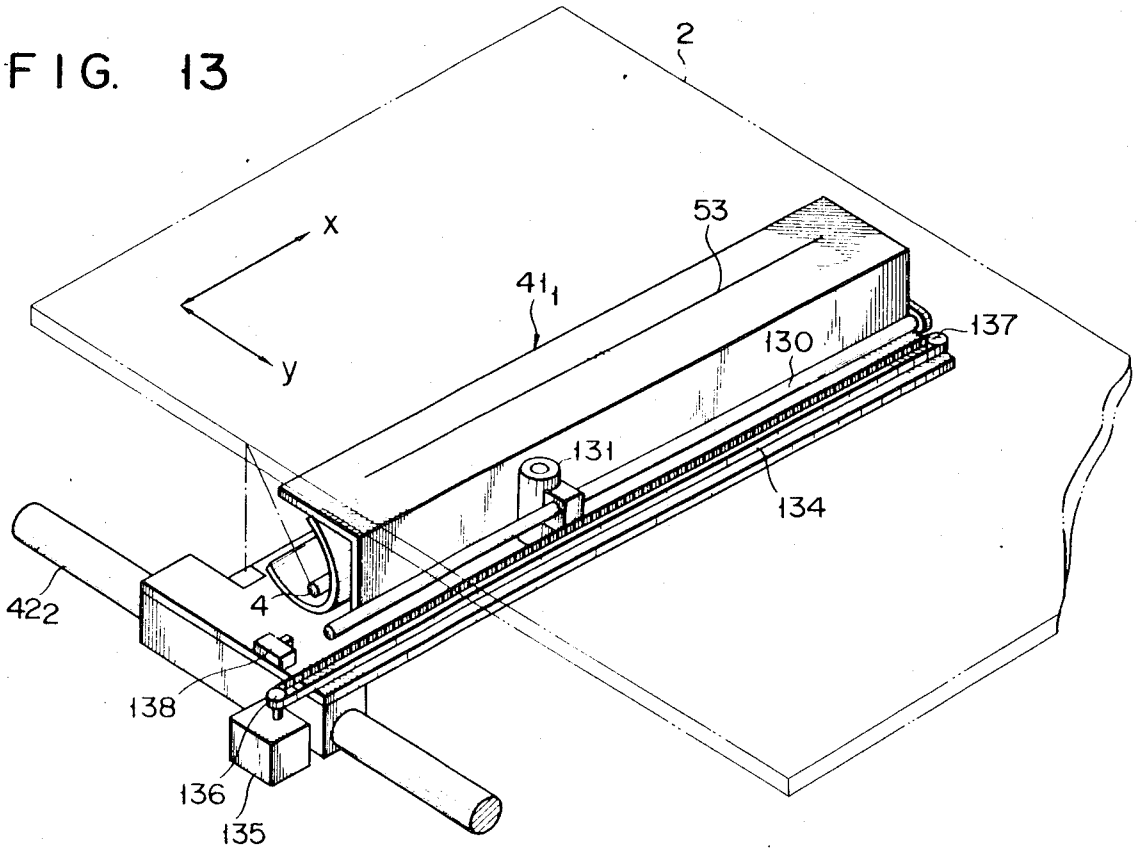
Figure 14:
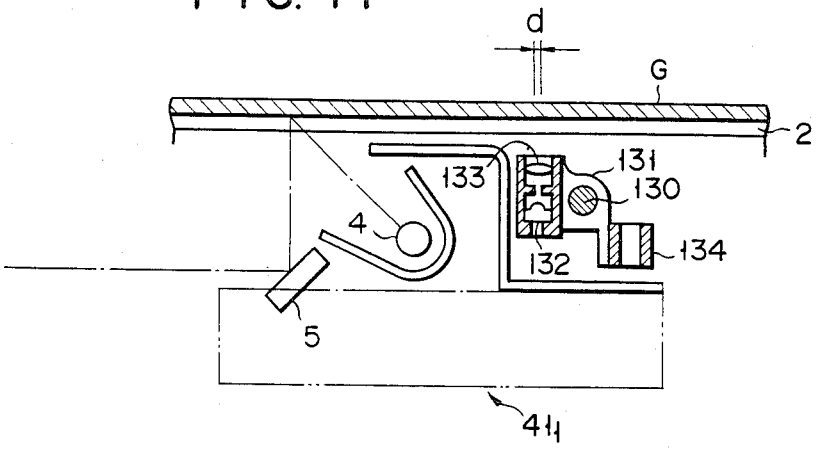

In FIGS. 13 and 14, a guide shaft 130 is disposed at that portion of the first carriage $41_1$ intercepting the light from the lamp 4, extending along the lamp 4. The guide shaft 130 is movably fitted with the spot light source 131 as the indicating means for indicating an erasure range of the original. As shown in FIG. 14, the spot light source 131 includes a light emitting element 132, such as a light emitting diode or lamp, and a lens 133 which are opposed to the original table 2.

A light beam emitted from the light emitting element 132 is applied to the original table 2 through the lens 133, as a spot light with a diameter d of, e.g., 2 mm. The spot light has enough brightness to be transmitted through an original G as thick as, e.g., a postcard set on the original table 2. The spot light source 131 is coupled to a timing belt (toothed belt) 134 extending along the guide shaft 130. The timing belt 134 is stretched between a pulley 136 mounted on the shaft of the stepping motor 135 and a driven pulley 137. As the stepping motor 135 is rotated the spot light source 131 is moved in a direction perpendicular to the scanning direction of the first carriage $41_1$.

A position sensor 138 formed of a microswitch for detecting the initial position of the spot light source 131 is attached to that portion of the first carriage $41_1$ which is located beside the end portion of the guide shaft 130 on the side of the stepping motor 135. When the spot light source 131 is moved, for example, it first abuts against the position sensor 134 to have its initial position detected thereby.

Figure 15:
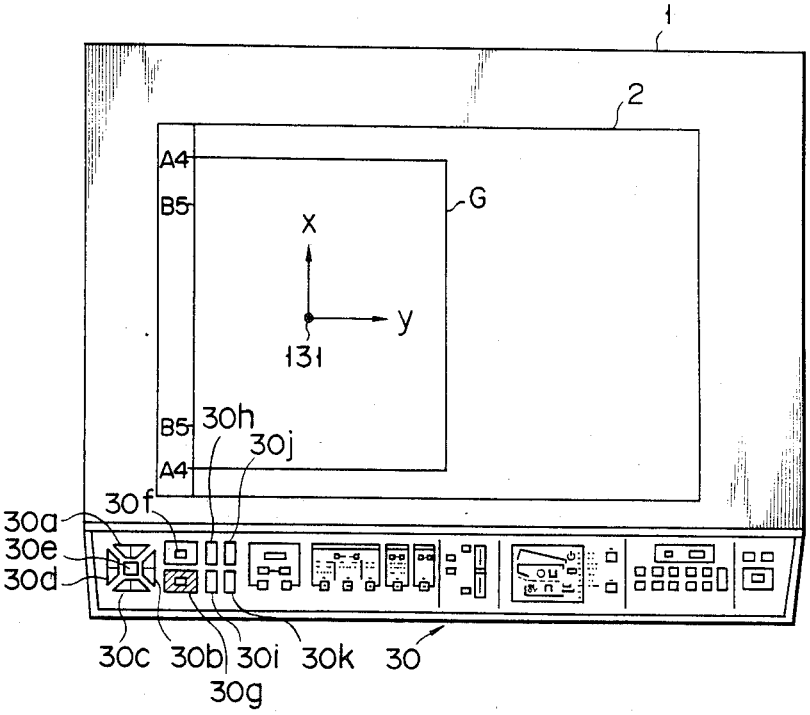
Figure 16:
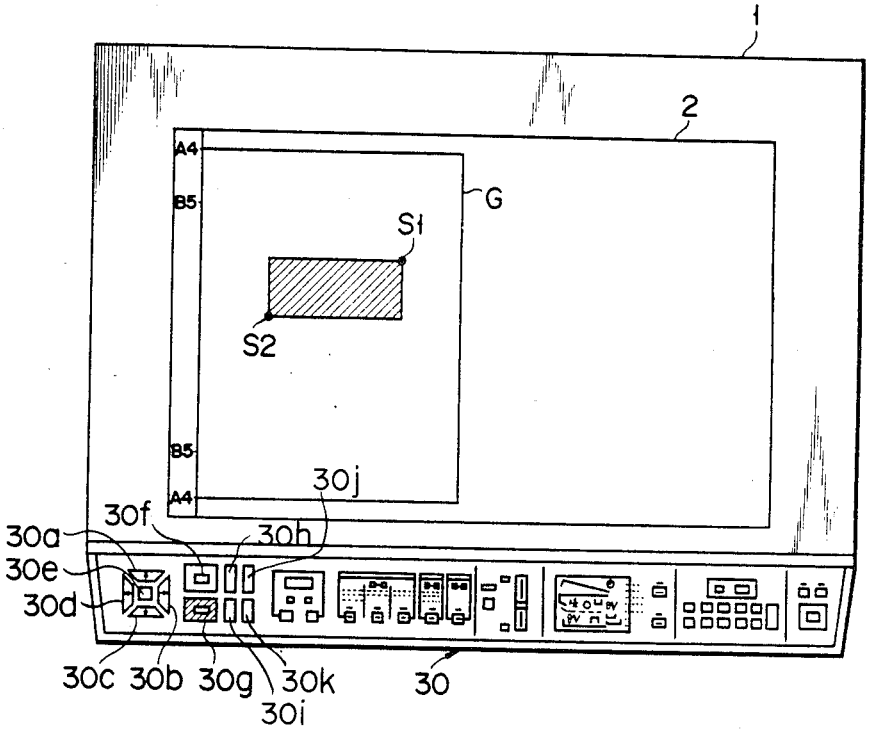
Figure 17:
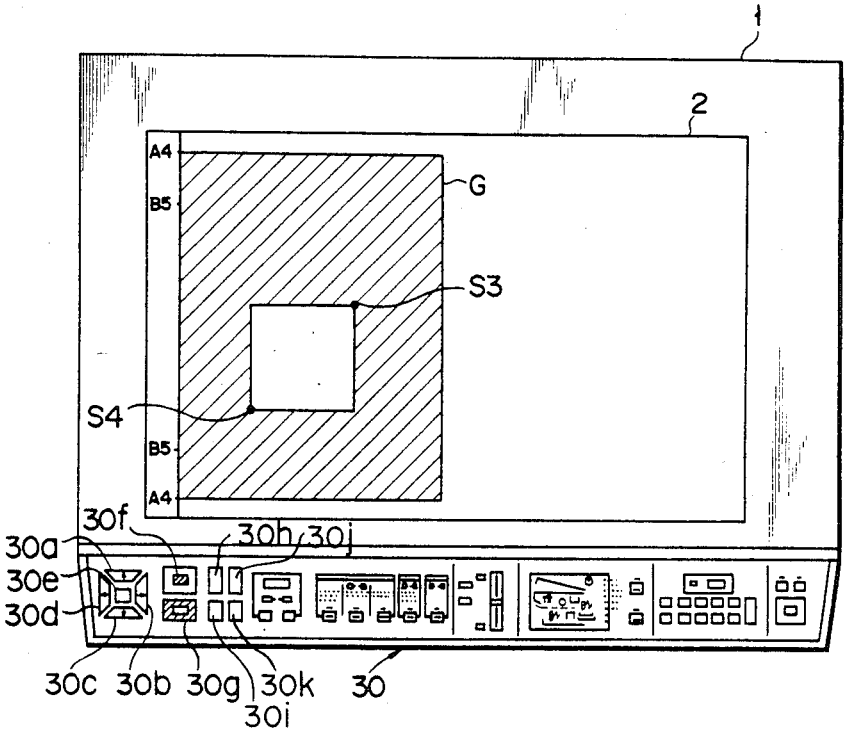

Referring now to FIGS. 15 to 17, there will be described a method for designating the erasure range of the original by means of the spot light source 131.

The spot light source 131 is moved by operating the operation keys 30*a* to 30*d*. When the operation keys 30*b* and 30*d* are depressed, the motor 33 is started, and the first carriage $41_1$ and the spot light source 131 are moved in the scanning direction (indicated by arrow y in FIG. 15). When the operation keys 30*a* and 30*c* are depressed, on the other hand, the motor 135 is started, and the spot light source 131 is moved in a direction (indicated by arrow x in FIG. 15) perpendicular to the scanning direction.

Observing the spot light transmitted through the original G, the operator operates the operation keys 30*a* to 30*d*. When the spot light reaches, for example, a spot S1 on the original G shown in FIG. 16, the operator depresses the position designating key 30*e*. Thereupon, the coordinate position (x1,y1) indicated by the spot S1 is stored in the main processor group 71 shown in FIG. 7. Likewise, if the position designating key 30*e* is depressed when a spot S2 on the original G is reached by the spot light, the position (x2,y2) of the spot S2 is stored in the main processor group 71. This position of the spot light can be detected by, for example, counting drive pulses delivered from the stepping motors 33 and 135. When the erasure range designating key 30*f* is depressed thereafter, a rectangular region (hatched region) having its two opposite vertexes on the spots S1 and S2 is designated as the erasure range, as shown in FIG. 16.

If the erasure range designating key 30*g* is depressed after designating spots S3 and S4 on the original G, the other region of the original G (i.e. not a square region having its two opposite vertexes on the spots S3 and S4) is designated as the erasure range, as shown in FIG. 17.

Figure 18A:
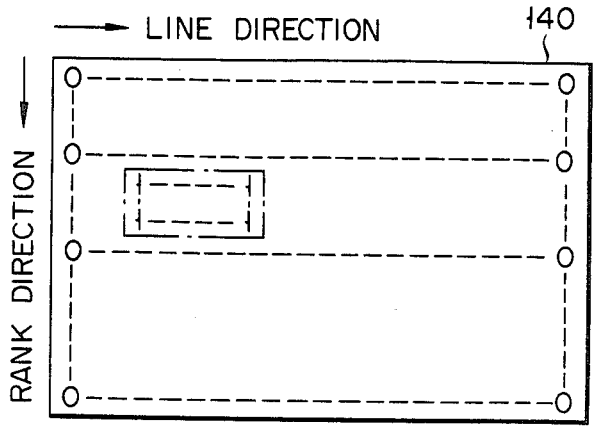
FIGS. 18A and 18B are plan views for explaining memory contents.
Figure 18B:
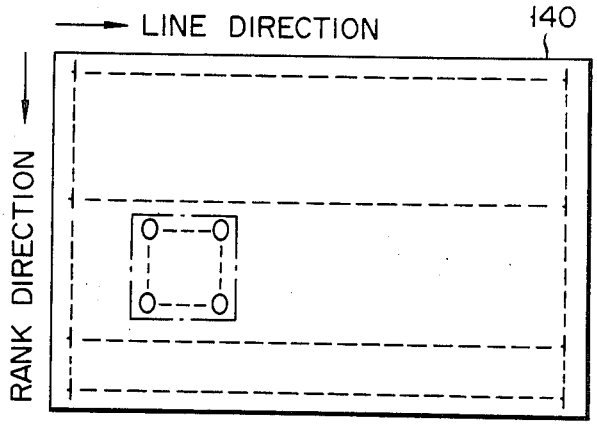

Thus, if the key 30*f* or 30*g* is depressed, the group 71 performs arithmetic operation in accordance with the specified two positions. Position data of the erasure area are set at logic "1" and position data of an area excluding the erasure area are set at logic "0". These position data are stored in the memory 140. A rank capacity of the memory 140 substantially corresponds to a value given by (moving distance of the source 131 along the x direction)÷(position resolution along the x direction). A line capacity of the memory 140 substantially corresponds to a value given by (moving distance of the source 131 along the y direction)÷(position resolution thereof along the y direction). The memory 140 comprises a RAM having the memory capacity described above. In the cases of FIGS. 16 and 17, high level signals are stored at addresses corresponding to the hatched area and low level signals are stored at other addresses in response to the data supplied from the group 71, as shown in FIGS. 18A and 18B, respectively.

In this manner, the original is placed on the original table such that the image surface face upward. When an erasure area is specified, the original is turned over along fixed scale $2_1$ on table 2. Therefore, information stored in memory 140 shown in FIGS. 18A and 18B is stored such that column order is inverted in practice.

Figure 19A:
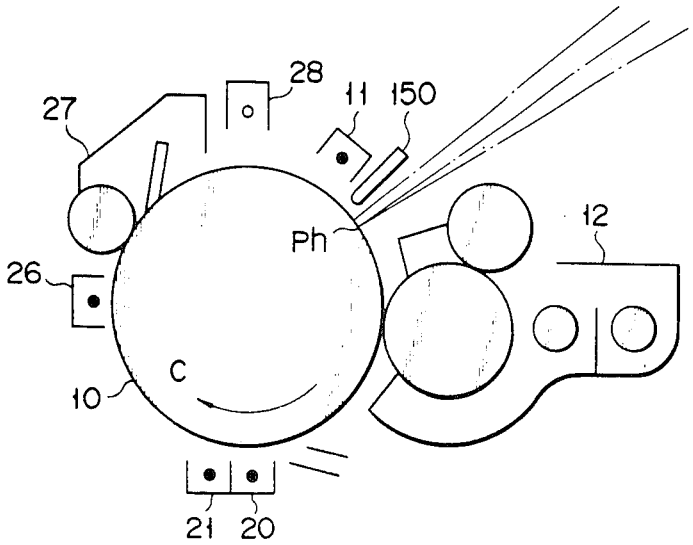
FIG. 19A is a side sectional view of the principal part showing an arrangement of the erasure array.
Figure 20:
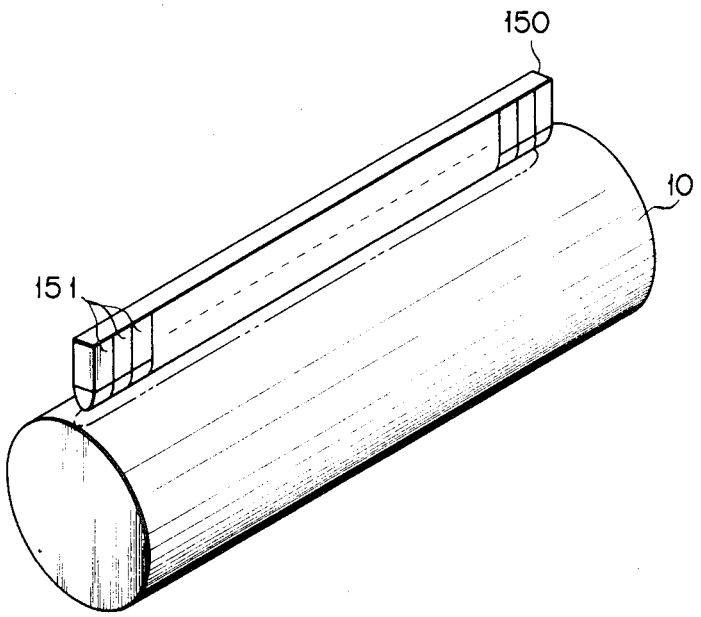
Figure 21:
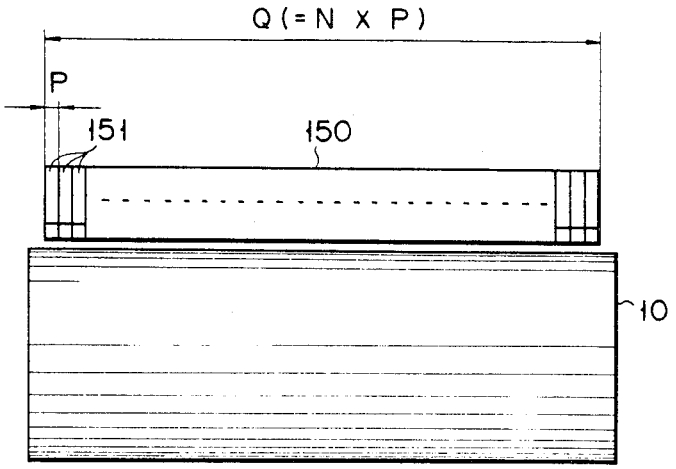
Figure 22A:
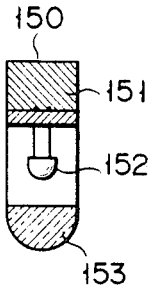
FIG. 22A is a side sectional view of the erasure array.
Figure 22B:
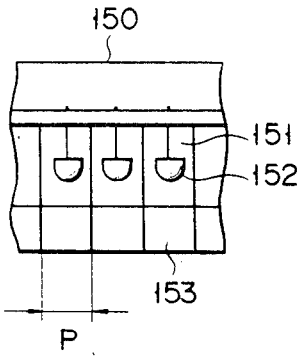
FIG. 22B is a partial front view of the erasure array.

As shown in FIG. 19A, on the other hand, the erasure array 150 as the erasing means is disposed close to the photosensitive drum 10, between the charger 11 and an exposure region Ph, for example. As shown in FIGS. 20 and 21, the erasure array 150 includes a plurality of shading cells 151 which are arranged in a direction perpendicular to the rotating direction of the photosensitive drum 10. As shown in FIGS. 22A and 22B, the cells 151 each contains therein a light emitting element 152 formed of, e.g., a light emitting diode. Moreover, a lens 153 for converging light from the light emitting element 152 on the surface of the photosensitive drum 10 is disposed at the opening portion of each cell 151 facing the photosensitive drum 10.

The number of light-emitting elements arranged in erasure array 150 corresponds to the same as the column capacity of memory 140. When the distance between light-emitting elements 152 is given by P and the number of elements is given by N, overall length Q of array 150 is given by $Q=N \cdot P$.

Figure 23:
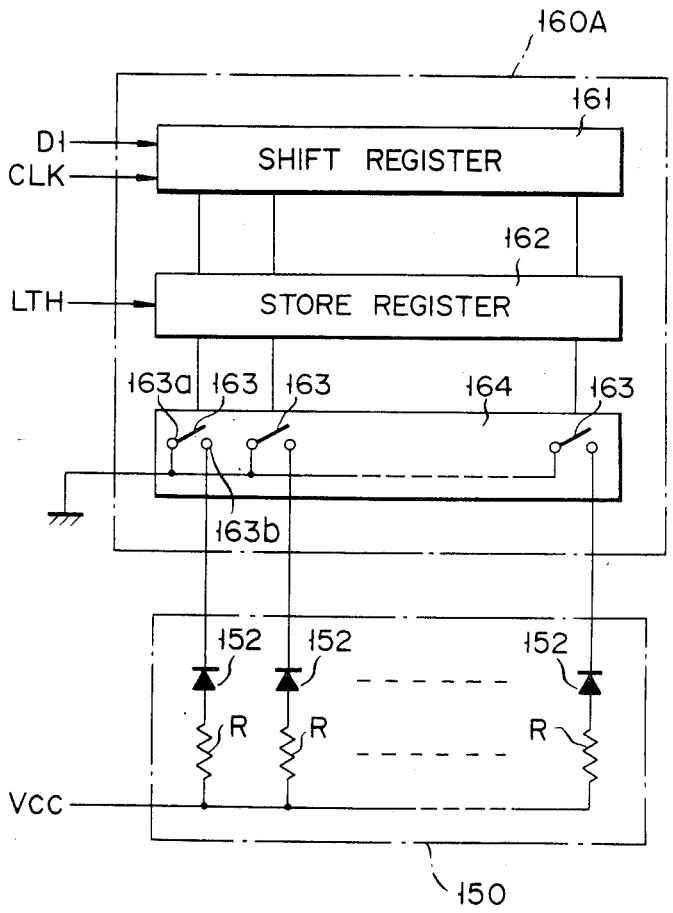

The array 150 is driven by an array drive section 160. As shown in FIG. 23, the section 160 comprises a shift register 161 having the same bit number as the rank bit number of the memory 140, a store register 162 for storing the content of the register 161, and a switching circuit 164 consisting of a plurality of switch elements 163 which are turned on/off in response to output signals from the register 162. Movable contacts 163*a* of the elements 163 are grounded, and stationary contacts 163*b* thereof are respectively connected to the cathodes of the elements (diodes) 152 constituting the array 150. The anodes of the elements 152 are connected to a power source VCC through the corresponding current limiting resistors R.

After, as the erasure area the unnecessary portion of the original is specified, he closes the original cover 11 and depresses the key $30_1$. The carriage $41_1$and drum 10 are driven, and one-rank data are sequentially read out along the line direction (FIGS. 18A and 18B of the memory 140. The readout data D1 are transferred to the register 161 in the section 160 in response to the clock signal CLK. After one-rank data is transferred to the register 161 and the charged portion of the drum 10 reaches the array 150, the group 71 generates a latch signal LTH. The storage data is supplied from the register 161 to the register 162 in response to the latch signal LTH. Since the array 150 is arranged between the charger 11 and the exposure portion Ph, the output timing of the latch signal LTH is controlled such that the one-rank data is transferred from the memory 140 to the register 162 prior to $\theta 1/\omega$ where $\theta 1$ is the angle between the array 150 and the portion Ph and $\omega$ is the peripheral velocity of the drum 10.

The elements 163 in the circuit 164 are controlled in response to the output signal from the register 162. When the output of the register 162 is set at high level, the elements 163 are turned on. When the output of the register 162 is set at low level, the elements 163 are turned off. The elements 152 connected to the elements 163 are turned on when the elements 163 are turned on. Otherwise, the elements 152 are turned off. A charged drum portion corresponding to the ON elements 152 is discharged, and the remaining portion is not discharged, so that a latent image is not formed in the discharged portion even if the surface of the drum 10 is exposed with light. In this manner, the unnecessary portion for one rank if erased. The data is thus read out from the memory 140 in units of ranks, thereby erasing the unnecessary image portion.

Figure 24:
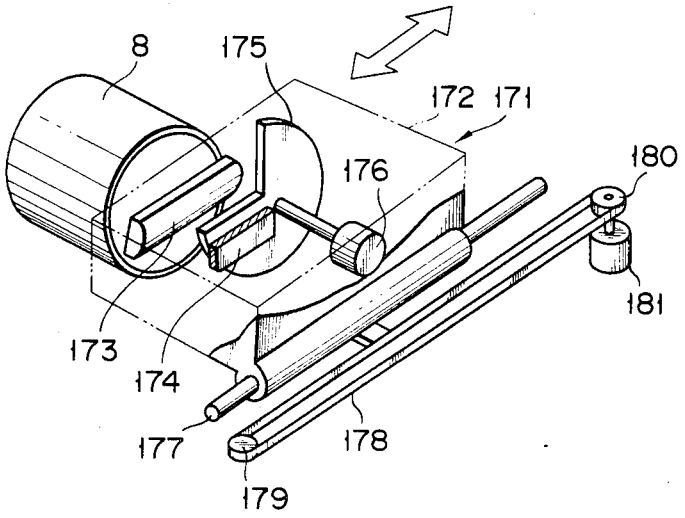
Figure 25:
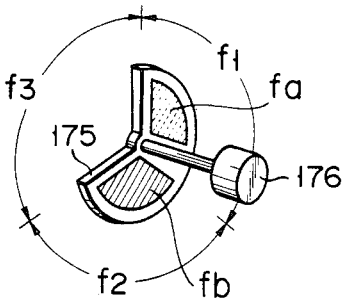

Now, the configuration of the first embodiment of the present invention will be described. In this embodiment, when color copying is specified by color specifying key 30*i* on said control panel 30, a CCD (charge-coupled device) unit 171 is introduced between lens block 8 for magnification and reduction and mirror $9_1$ and the machine is set ready for color copying. As seen in FIG. 24, said CCD unit 171 is formed of a lens 173 for conveying optical images from lens block 8 for magnification and reduction to the inside of case 172, a CCD 174 on which the images are focused, a filter member to be inserted between said CCD 174 and lens 173 and a motor 176 for turning said filter member 175. Said CCD unit 171 is pivotally held by a guide shaft 177 which is provided rectangularly to the optical axis of lens block 8 for magnification and reduction and then fixed to a timing belt 178 which is provided along said guide shaft 177. Said timing belt 178 operationally connects pulleys 179 and 180, of which pulley 180 is driven by a motor 181. Thus, when motor 181 is set in motion, CCD unit 171 moves along guide shaft 177 in the direction indicated by the arrow in FIG. 24. The filter member 175 has a configuration as shown in FIG. 25. In other words, the guide member 175 is generally disc shaped and divided into three equal sections along its circumference, which are designated as $f_1 f_2$ and $f_3$ respectively. In sections $f_1$ and $f_2$, there are respectively provided filters fa and fb which respectively comprise a plurality of colors in combination, gray and red or blue and gray for instance. Section $f_3$ is, on the other hand, notched so that light coming from lens block 8 for magnification and reduction can directly strike CCD 174.

Figure 26A:
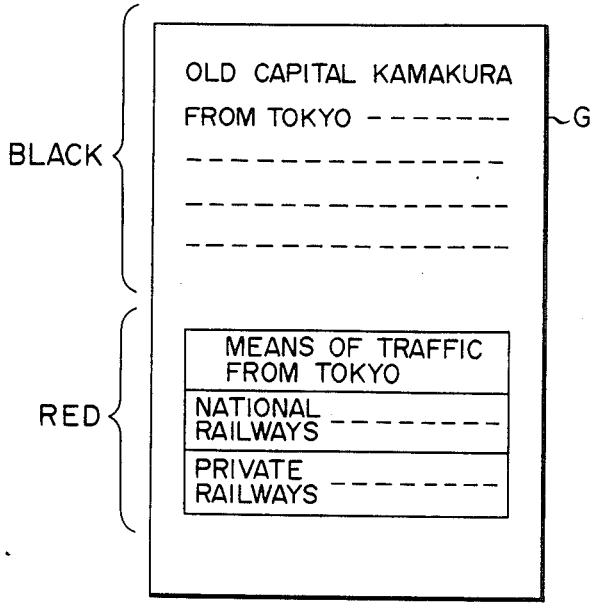
Figure 26B:
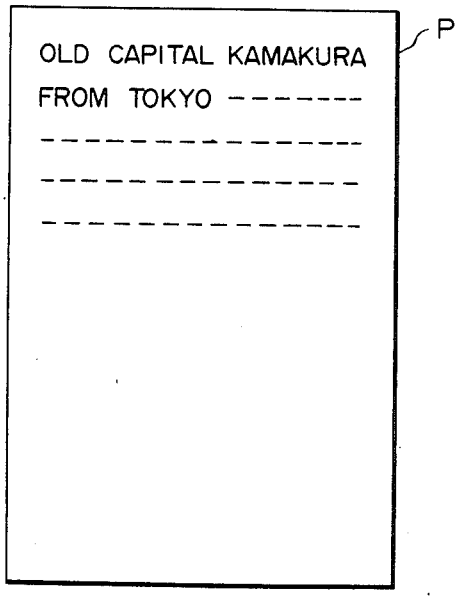
Figure 26C:
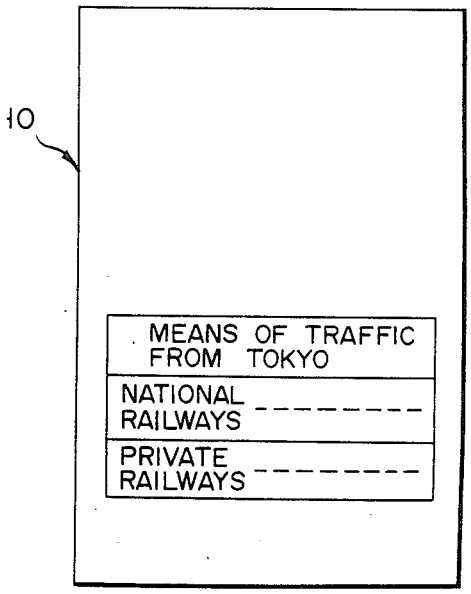
Figure 27:
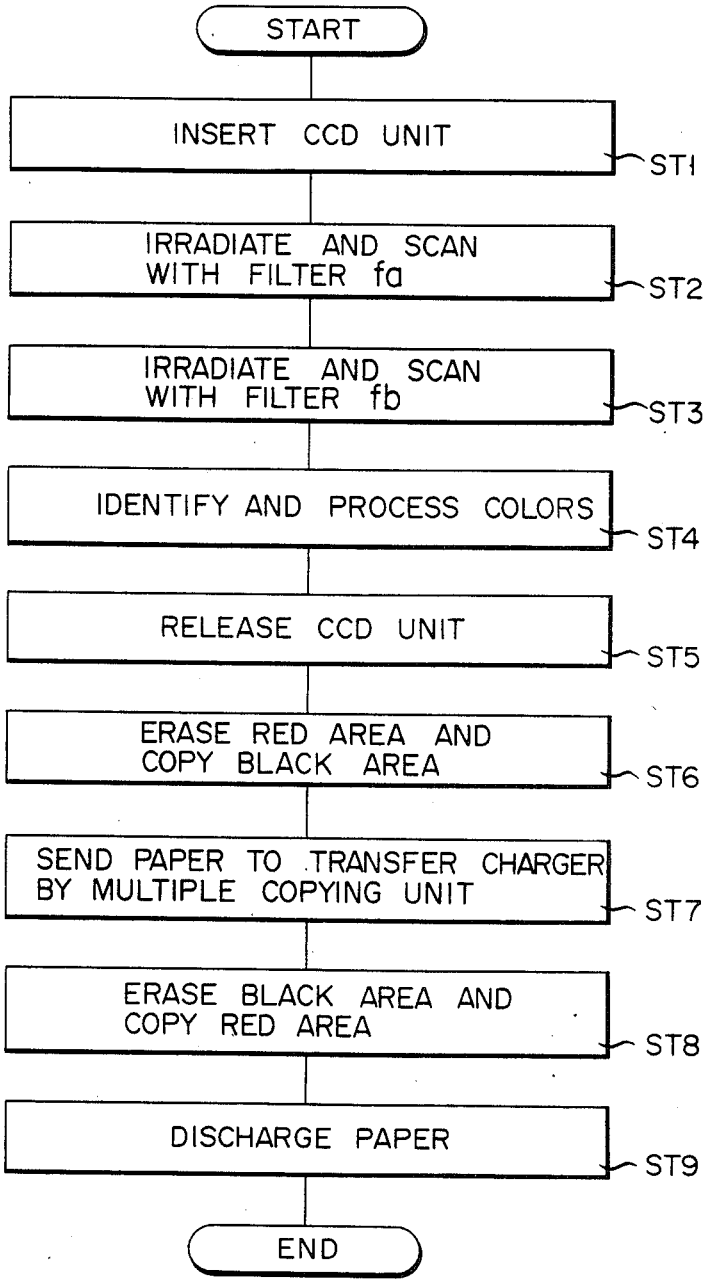
Figure 28:
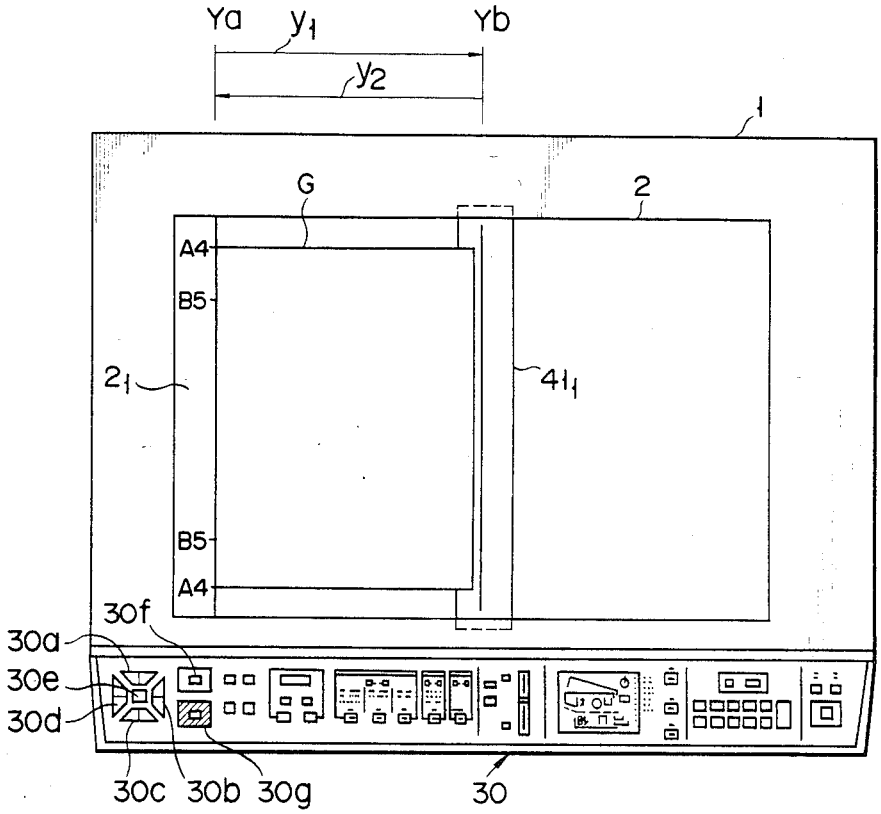

Next, color copying operation of a copying machine having the configuration as described above will be described. When an original G having red and black colors is to be copied, as seen in FIG. 26A, the original G is placed in position on the original table 2 and color specifying key 30*i* and copy key $\mathbf{30_1}$ are depressed successively to effect the control operation as shown in FIG. 27 of the main processor group 71. More specifically, in step $ST_1$, CCD unit 171 is introduced between lens block 8 for magnification and reduction and mirror $\mathbf{9_1}$. Then, in step $ST_2$, one of the filters for example filter fa, of said filter member 175 is inserted between lens 173 and CCD 174. Under this condition, the first carriage $\mathbf{41_1}$ is moved in the direction to go away from the fixed scale $\mathbf{2_1}$ as shown by the arrow $y_1$ in FIG. 5 and an exposure scanning operation is initiated. During this scanning operation, the light coming from lens block 8 for magnification and reduction is led to CCD 174 via filter fa. The photoelectrically converted output signals of CCD 174 are then fed to A/D converter 192 by way of amplifier 191, in which the signals are converted into corresponding digital signals. The digital signals are stored in memory 194 by way of DMA 193. When the first carriage $\mathbf{41_1}$ arrives at the position Yb as indicated in FIG. 28 to complete an scanning operation for the original G, said filter member 175 is rotated in step $ST_3$ to put filter fb between lens 173 and CCD 174. Under this condition, the first carriage $\mathbf{41_1}$ is moved from the position Yb in the direction as indicated by the arrow y2 in FIG. 5 to initiate another exposure operation for the original G. During this scanning operation, the light coming from lens block 8 for magnification and reduction is led to CCD 174 via filter fb. The photoelectrically converted output signals of CCD 174 are then fed to A/D converter 192 by way of amplifier 191, in which the signals are converted into corresponding digital signals as shown in FIG. 7. The converted signals are then stored in a storage area of memory 19 which is different from the storage area for the signals as described above by way of DMA 193. When the first carriage $\mathbf{41_1}$ arrives at the position Ya as indicated in FIG. 5 to complete the second scanning operation for the original G, the image data that have been stored in said memory 194 are processed for color identification in step $ST_4$. In this step, the two different date stored in memory 194 undergo an addition or subtraction operation, for example, so that the black and red areas of the original image are identified and then the positional date for the black and red areas of the original G are stored in memory 194. For positional data to be used for the purpose as described above, two distinct storage areas having a storage capacity which corresponds to the image resolution of the original may be provided in memory 194, where high level signals are stored for the red area of the original image and low level signals for the rest of the area of the original image in one of the storage area and high level signals are stored for the black area of the original image and low level signals for the rest of the areas of the originals image in the other storage area. Thereafter, in step $ST_5$, CCD unit 171 is drawn out of the light path of lens block 8 for magnification and reduction. Then, also in step $ST_5$, erasure date for the red area are generated and stored in said memory 140 from the positional data for the red area that have been stored in memory 194. Under this condition, an copying operation is conducted for the black area of the original G by means of block toner containing developing unit $\mathbf{12_2}$ and said erasure array 150. In this operation, the first carriage $\mathbf{41_1}$ is moved from the position Ya in the direction as indicated by the arrow $y_1$ in FIG. 28 to perform an exposure scanning. As a result, erasure data is supplied to erasure array 150 from memory 140 and the electric charges for the red area are erased from the surface of photosensitive drum 10. Thus only the black area of the original G is copied on the paper P as shown in FIG. 26B. Later in step $ST_7$, the paper P on which only the black area has been copied is again transferred to the transfer charger by multiple copying unit 128 that has been described earlier. Then in step $ST_8$, erasure data for the black area are generated and stored in said memory 140 from the positional data for the black area that have been stored in memory 194. Under this condition, an copying operation is conducted for the red area of the original G by means of red toner containing developing unit $\mathbf{12_1}$ and said erasure array 150. During this operation, the first carriage $\mathbf{41_1}$ is moved from the position Ya in the direction as indicated by the arrow $y_1$ in FIG. 28 to perform an exposure scanning. As a result, erasure data is supplied to erasure array 150 from memory 140 and the electric charges for the black area are erased from the surface of photosensitive drum 10. Thus only the red area of the original G is copied on the surface of photosensitive drum 10 as shown in FIG. 26C. At this time, in a concerted manner, the paper P that has been transferred to the transfer charger by means of said multiple copying unit 128 is set, on which the red area of the original image is copied. Now, the full image which is composed of red and black areas and exactly identical with that of the original G has been formed on the paper P. Finally, in step $ST_9$, the paper P is sent to paper discharger tray 25 by way of paper discharger roller $\mathbf{60_4}$.

It should be noted that in this embodiment, if monocolor specifying key 30*h* is depressed, an ordinary multiple copying operation is selected and, by depressing red specifying key 30*j* or black specifying key 30*k*, an monocolor copying operation is carried out using red or black toner respectively.

In the embodiment as described above, the colors and the position of the original image are identified by CCD unit 171 and the color and the positional data thus obtained are used to appropriately control developing units $12_1$ and $12_2$ and multiple copying unit 128. This means that any color(s) of the original can be selectively chosen to form a copied image so that eventually a full color copy may be obtained.

Furthermore, in this embodiment, since a copying machine which uses ordinary toner agents is incorporated, its construction is relatively simple and hence can be realized less expensively.

Figure 19B:
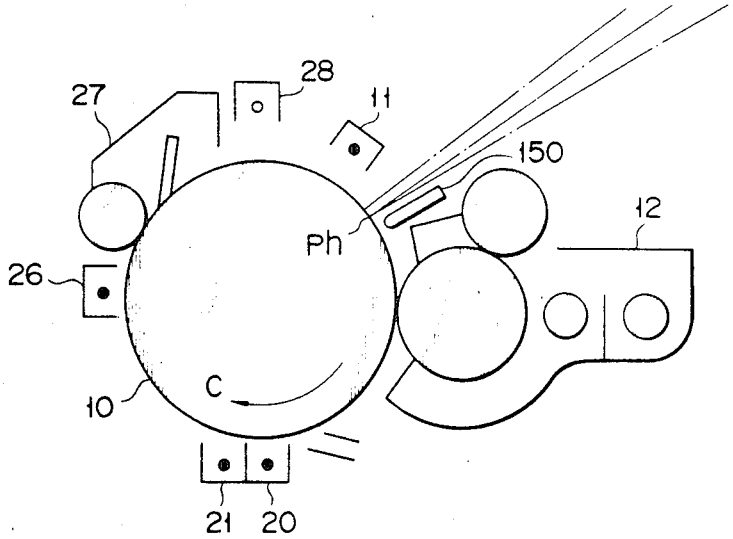
FIG. 19B is a side sectional view of the principal part showing another arrangement of the erasure array.

It should be noted that the present invention is not limited to the above embodiment and a number of modifications thereof are possible. For example, location of said erasure array 150 is not limited to that of FIG. 19A and can be selected somewhere between the exposure section Ph and developing unit $12_1$ as shown in FIG. 19B so that any part(s) of the formed electrostatic latent image may be erased according to specification.

It should also be noted that the colors and the number of the filters in the filter member are subject to various modifications and, if the number of developing units and of types of toners used is increased accordingly, multicolor copying will be made possible without difficulty.

It will not be necessary to say that various modifications are possible within the scope of the present invention.

As described above in a detailed manner, according to the present invention, it is possible, by means of an image forming system which uses ordinary developing agents to selectively form a color image from a multicolor original image and hence to provide an economically advantageous image forming apparatus.

Now several modified embodiments of the present invention will be described.

In a first modified embodiment, there is provided a lens block of the type as aforementioned for magnification and reduction which can be moved along a fixed scale for positioning of an original so that the image to be formed from the original may be deviated relative to the central position of the fixed scale to which a sheet of copying paper is supplied and an operator may appropriately select positioning of the original and there are provided indexes under an original table which can be moved so that the longitudinal limits of an image forming area may be specified relative to the original image.

Figure 29:
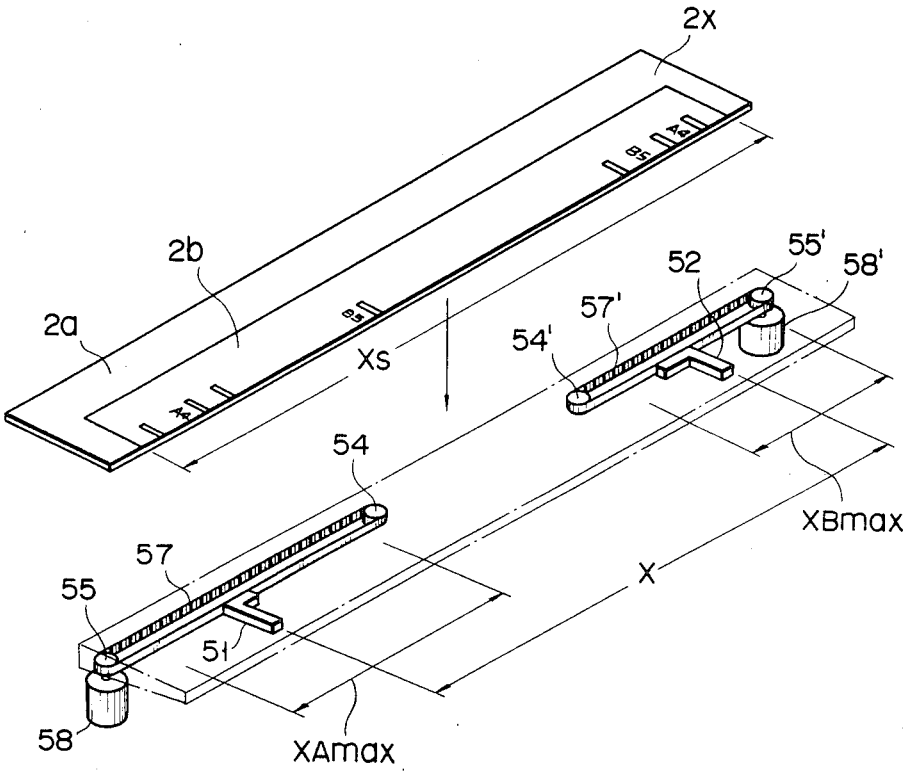

One of said indexes 51 is, as shown in FIG. 29, provided on the belt 57 which functionally connects pulleys 54 and 55, while the other of said indexes 52 is, as shown also in FIG. 29, provided on the belt 57' which functionally connects pulleys 54' and 55'. Said pulleys 55 and 55' are rotatively driven by motors 58 and 58' respectively and, since the motors 58 and 58' can be individually driven depending on selection of central positioning or deviated positioning, size of copying paper and magnifying power, the position of the indexes 51 and 52 as well as the distance therebetween are adjustable. The distance X between the indexes 51 and 52 is the longitudinal span of the area that can be used for copying and XA max and XB max indicate the maximum movable distance of indexes 51 and that of index 52 respectively.

Figure 30A:
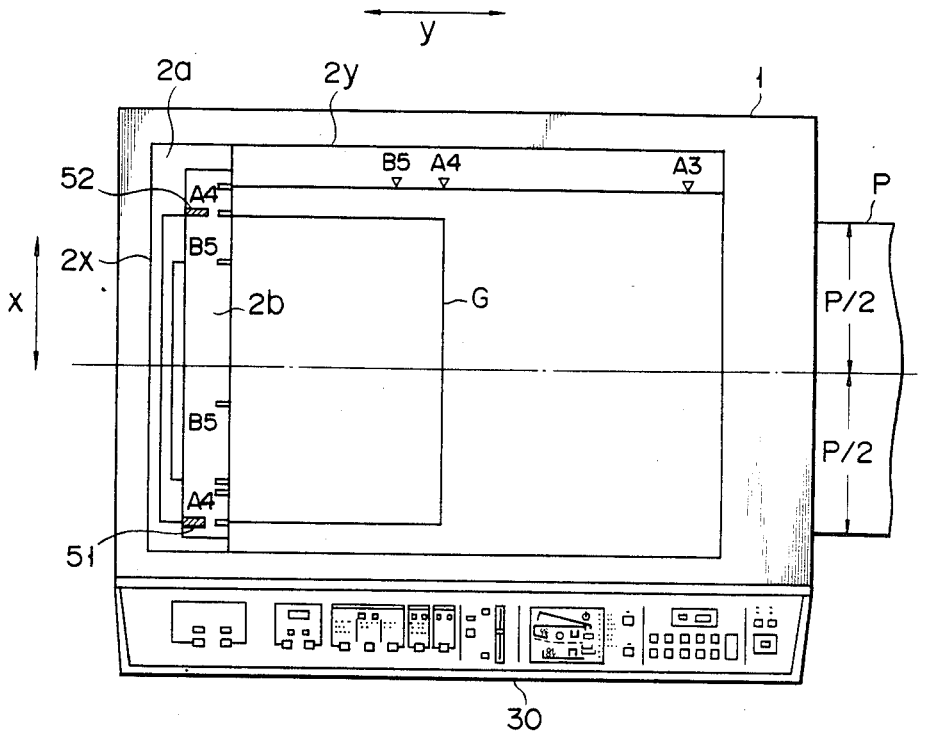
FIGS. 30A and 30B are partially cut-out plan views of the principal section of the first modified embodiment, illustrating positions for placing a original for set-up.
Figure 30B:
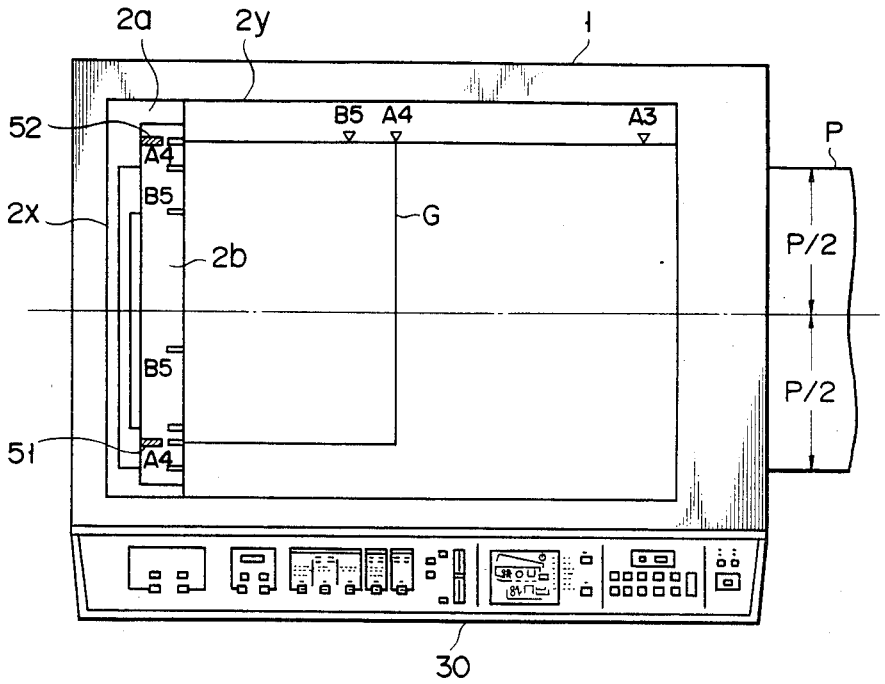
Figure 31:
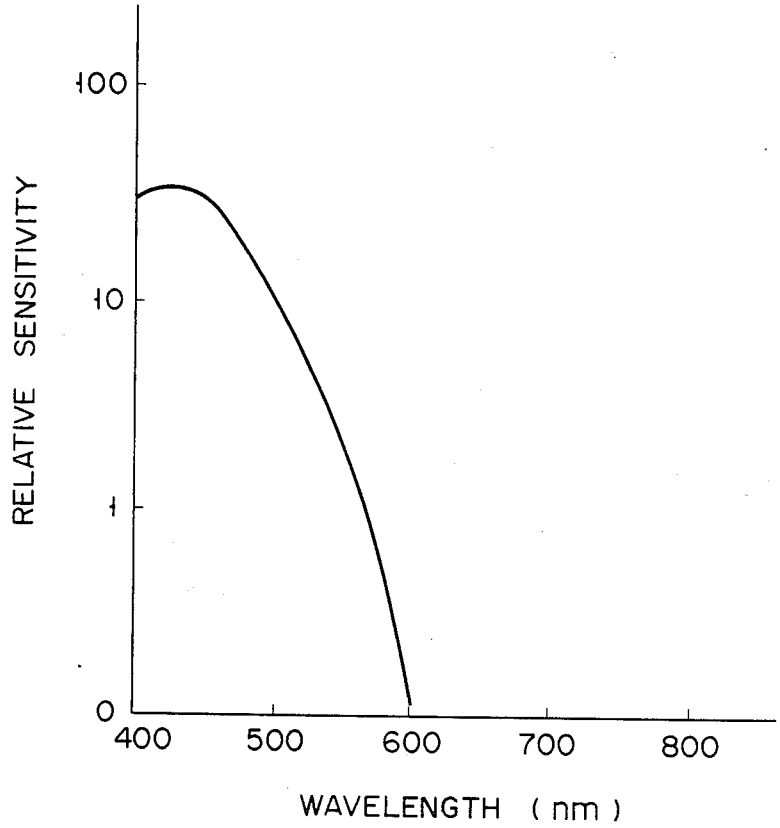

If, for example, central positioning, A4 paper size and commensuration are selected, motor 58, 58' are driven individually so as to set the indexes 51, 52 in the positions which are good for central positioning of the fixed scale 2X as shown in FIG. 30A. If, on the contrary, deviated positioning, A4 paper size and commensuration area selected, motor 58, 58' are driven individually so as to set the indexes 51, 52 in the positions which are good for deviated positioning of the fixed scale 2X, where the sheet abuts the fixed scale 2Y, as shown in FIG. 30B. It should be noted that the longitudinal span, or the span in the X direction, of the area that can be used for copying (X, Y) is limited by indexes 51, 52 which are provided under the lower surface of the fixed scale 2X, whereas the lateral span, or the span in the Y direction, of the area that can be used for copying (X, Y) is limited by the scale 53 located on the upper surface of the said first carriage $41_1$ and the fixed scale 2Y.

Said fixed scale plate 2X is consisted of a transparent section 2*a* and a white opaque section 2*b*. The width of said transparent section 2*a* defines the maximum width Xs of the area than can be used for copying. Therefore, if either index 51 or 52 is moved beyond the limit of the maximum width Xs of the area for copying, it goes under the opaque section 2*b* and can not be seen by the operator.

In an second modified embodiment, in which the optical property of an photosensitive drum of not responding to a specific color, blue for example, is utilized, the erasure area of an original is specified not by movement of a spot light source as aforementioned but by coating the area with blue ink of a pen which is provided for this purpose and the area thus coated with blue ink is irradiation scanned by a CCD unit which is slidably provided in the light path of a lens block for magnification and reduction and in which a number of filters are used successively to identify the area. The identification data thus obtained is then used to operate an erasure array to selectively erase the image that has been formed on a photosensitive drum.

As described above, in the second modified embodiment, the area of an original image that is to be erased is coated with ink of a special type. The ink for specifying an erasure area has spectral characteristic of reacting to said CCD 174 but not reacting to the photosensitive drum 10. For example, if the photosensitive drum 10 is of selenium (Se) type, since it is highly sensitive to blue light, a special pen containing blue ink with wavelength of 400 to 500 (nm) is used.

Figure 32A:
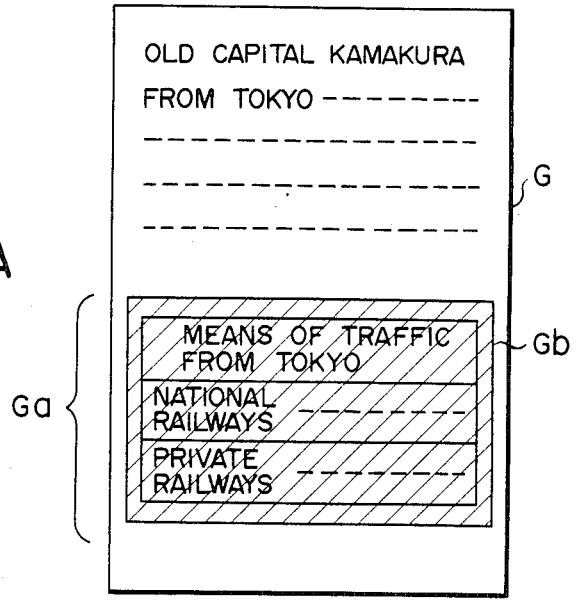
Figure 32B:
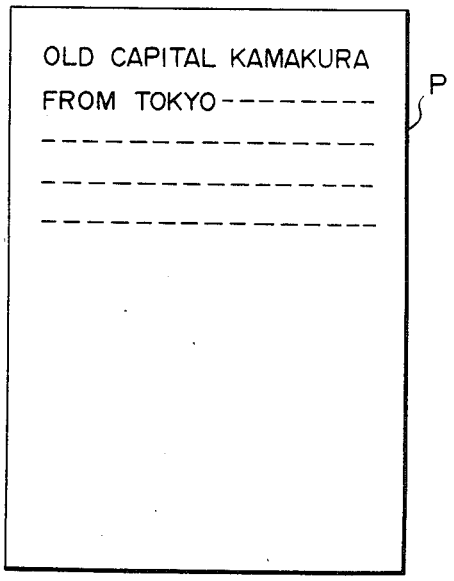
Figure 33:
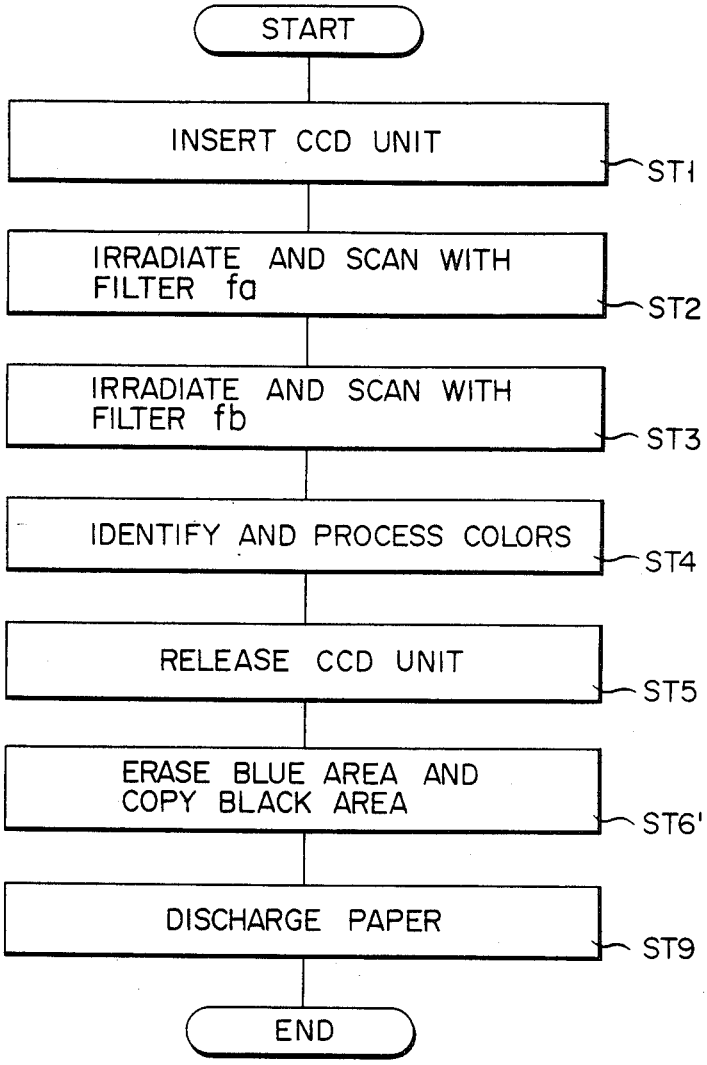

If, as shown in FIG. 32A, the black area Ga of the original G is to be erased, the area Ga which is indicated by inclined lines is coated with blue ink Gb of said special pen. In this state, the area Ga is visually discernible because of the blue ink. The original G is then placed on the original table 2 and, when the erasure specification key (not shown) and then the copying key are depressed, a copying operation comprising the steps as shown in FIG. 33 is carried out under the control of the main processor group 71. Since steps $ST_1$ to $ST_5$ and the $ST_9$ in FIG. 33 are identical with those in FIG. 27, only the remaining step $ST_6$, will be described below.

In the step $ST_6'$, erasure data for the blue area Gb is generated from the positional data for the blue area Gb that have been stored in memory 194 and stored in said memory 140. More specifically, high level signals are stored in the addresses allocated for the blue area and low level signals are stored in the rest of the addresses. Under this condition, the copying operation of the black area of the original G is carried out using developing unit $12_2$ containing black toner and said erasure array 150. More specifically, the first carriage $41_1$ is moved from the position Ya in the direction of the arrow $y_1$ shown in FIG. 28 for irradiation scanning of the original G. Along this operation, erasure data are supplied to array driving unit 160 from memory 140 and erasure array 150 is operated in accordance with said erasure data to erase the electric charges on photosensitive drum 10 which correspond to the blue area Gb. Therefore, after developing and transferring operation, only the area other than that has been coated with blue ink Gb of the original image is copied on sheet P.

According to a third modified embodiment of the present invention, lens block 8 for magnification and reduction is moved at least to the positions other than that of enlargement for specifying the erasure area of an original by moving the spot light source. This will be described more detailedly hereinafter.

Figure 34:
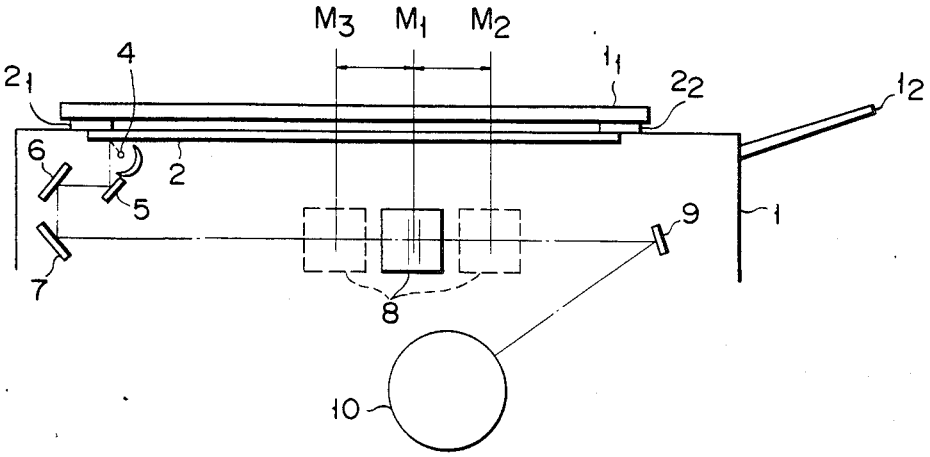

FIG. 34 shows the relationship between mirrors 6, 7 and lens block 8 for magnification and reduction. For magnification or reduction, the light path length (the distance between the surface of the original and photosensitive drum 10) and the position of lens block 8 for magnification and reduction should be changed according to the equation shown below.

$$1/a+1/b=1/f$$

In other words, lens block 8 for magnification and reduction is moved from commensurate position $M_1$ to position $M_2$, in the case of reduction, or to position $M_3$, in the case of magnification. The light path length is altered by moving mirrors 5, 6, 7.

Figure 35:
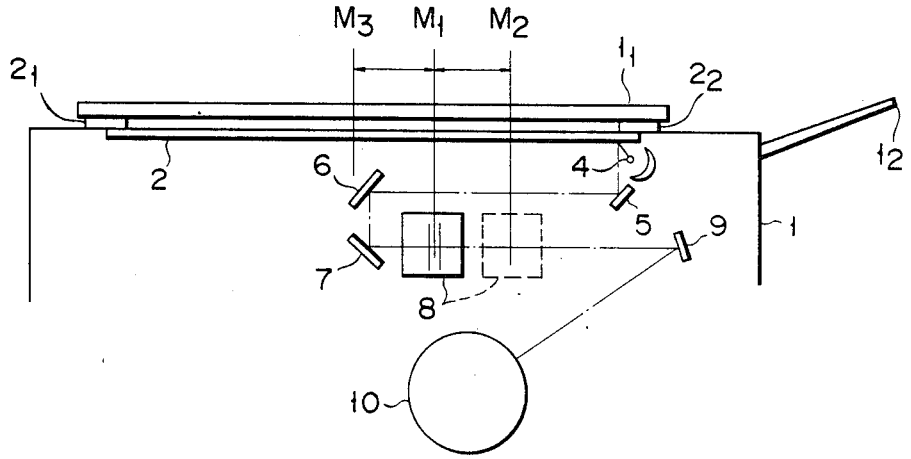
Figure 36:
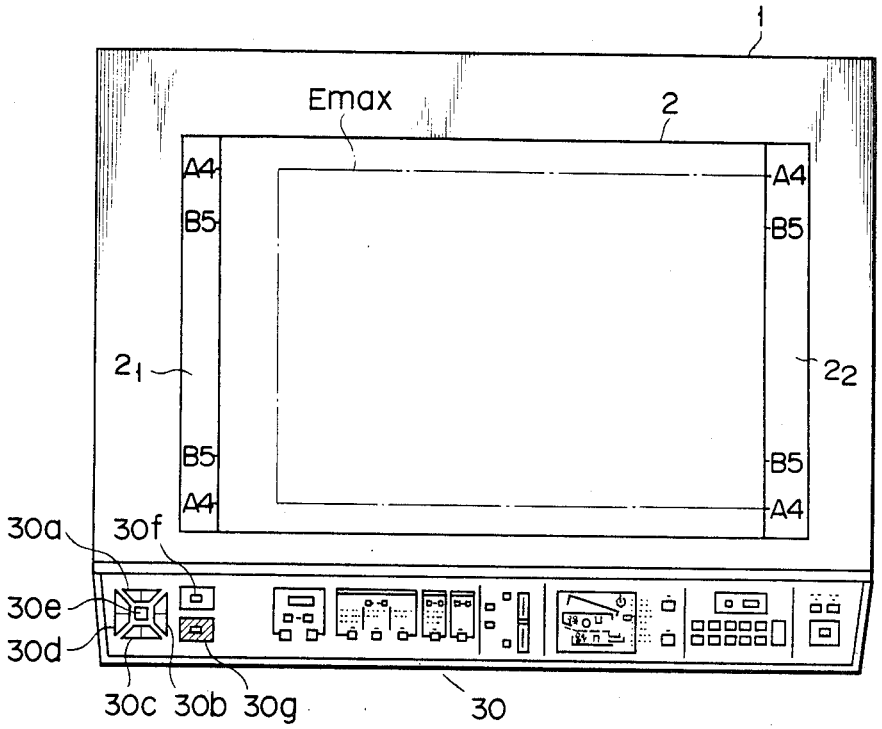

In most of the copying machines in the market in recent years, in view of reduction of overall machine sizes, mirrors 6, 7 are moved up to the close proximity of lens block 8 for magnification and reduction located in commensurate position $M_1$ as seen in FIG. 35 whose original table 2 is scanned to the limit. This means that, when an erasure area is specified within the maximum erasure area Emax with spot light source 131 which is described earlier as shown in FIG. 36, movement of spot light source 131 can be obstructed if lens block 8 for magnification and reduction is in the enlargement position. Therefore in this third modified embodiment, when an erasure area is specified, lens block 8 for magnification and reduction is automatically moved to an position other than the one for enlargement $M_3$.

Figure 37:
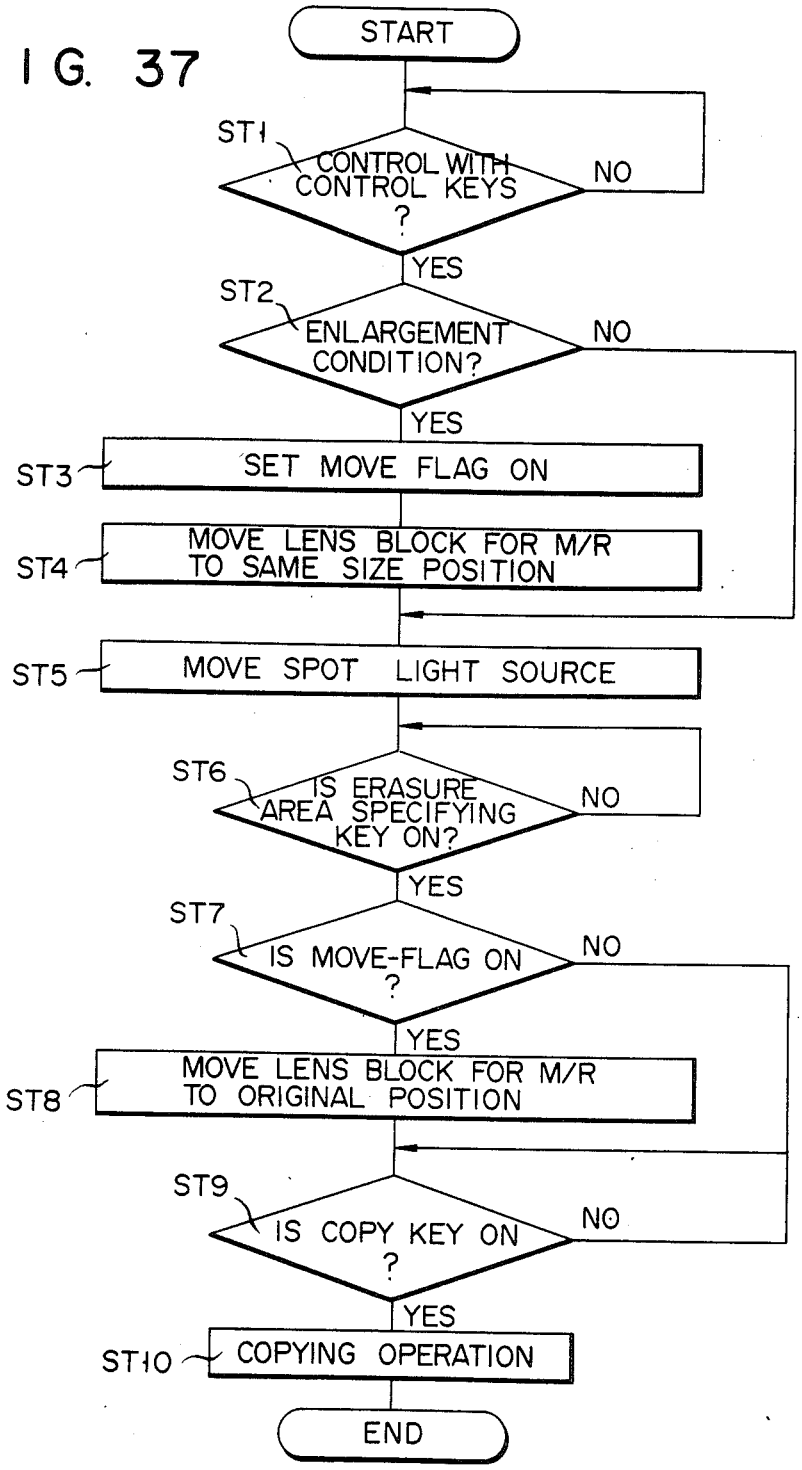

When an original is placed somewhere along the fixed scale $2_2$ which is located on the edge opposite to the fixed scale $2_1$ and then any of the control keys 30*a* to 30*d* of the control panel 30 is depressed, a control operation comprising the steps as shown in FIG. 37 is carried out in said main processor group 71. Namely, in step $ST_{11}$, *if any of the control keys* 30*a* to 30*d* has been depressed is determined. If yes, the control operation proceeds to step $ST_{12}$, in which if lens block 8 for magnification or reduction is in the enlargement position is determined from the condition of magnifying power specifying key $30_6$ and that of zoom key $30_7$. If it is determined that a magnifying power has been selected, the control operation proceeds to step $ST_{13}$, in which the move-flag is turned on. Then, after lens block 8 for magnification and reduction is moved to, for instance, commensurate position, the control operation goes to step $ST_{15}$. If, on the other hand, it is determined that lens block 8 for magnification and reduction is not in the enlargement position, the control operation skips to step $ST_{15}$. In step $ST_{15}$, spot light source 131 is moved according to which one of the control keys 30*a* to 30*d* has been depressed to specify the erasure area of the original. Then in step $ST_{16}$, if erasure area specifying keys 30*f*, 30*g* have been depressed is determined and, if yes, the control operation proceeds to step $ST_{17}$, in which if said move-flag is on is determined. If yes, lens block 8 for magnification and reduction is returned to the original position in step $ST_{18}$ and the control operation goes to step $ST_{19}$. If, on the other hand, it is determined in step $ST_{17}$ that move-flag is off, the control operation skips and goes directly to step $ST_{19}$. In step $ST_{19}$, if copying key $30_1$ is on is determined and, if yes, an erasing and copying operation as described earlier is carried out in step $ST_{20}$. With completion of the erasing and copying operation, all the control procedures come to an end.

Figure 38:
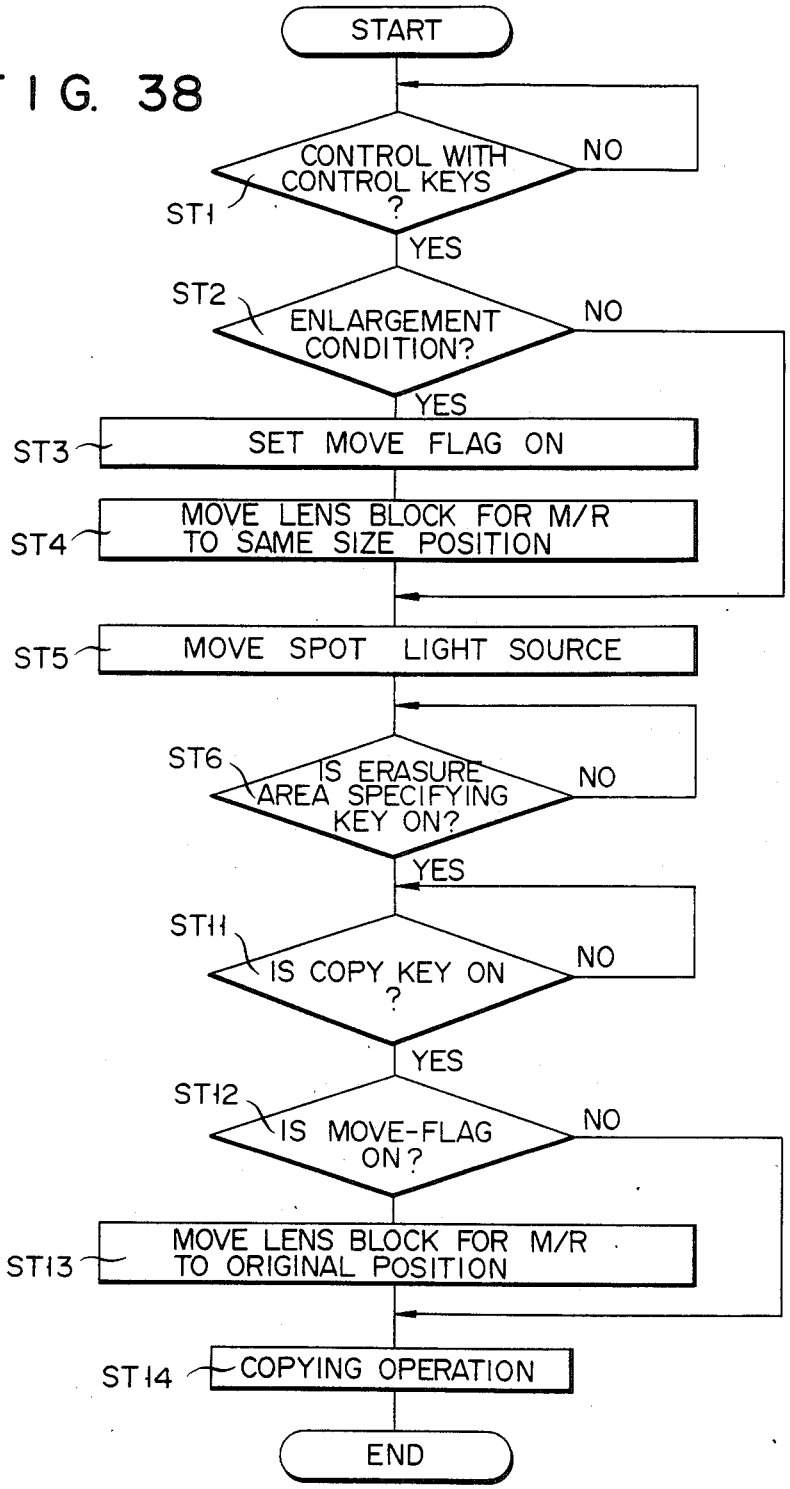

While the timing of the returning action of lens block 8 for magnification and reduction is set in accordance with the condition of erasure area specifying key 30*f*, 30*g* in the above description, steps $ST_{21}$ to $ST_{24}$ may be added to the control operation as shown in FIG. 38 so that if erasure area specifying key 30*f*, 30*g* are on is determined in step and then copying key $30_1$ is on is determined in step $ST_{21}$ in order to move lens block 8 for magnification and reduction in accordance with the condition of the move-flag when copying key $30_1$ is found to be on. It should be noted that in FIGS. 37 and 38, the corresponding steps carry identical step numbers.

This embodiment is advantageous particularly when a copied image should undergo editing because any undesired areas of an original can be specified for erasure. And when spot light source 131 is moved through operation of control keys 30*a* to 30*d*, lens block 8 for magnification and reduction is moved to any position other than the one for enlargement. Therefore, spot light source 131 can be moved to the upmost limit of the area that can be specified for erasure without obstruction.

Moreover, since lens block 8 for magnification and reduction can be moved at the time of specifying an erasure area, sizes of the body of a copying machine according to the present invention can be maintained at a relatively reduced level.

A copying machining according to the present invention is highly operable since lens block 8 for magnification and reduction is moved automatically under the control of control keys 30*a* to 30*d*.

According to a fourth embodiment of the present invention, there is provided an image forming apparatus comprising an original table which is equipped with a pair of fixed scales separately located at the opposite ends of the table for positioning of an original, said apparatus further comprising a pair of indexes under each of said fixed scales movably provided to define the longitudinal limits of a copying area for the image of a given original and a pair of scales under said original table movably provided to define the lateral limits of the copying area for the image of the given original, the copying area being defined by one of said pairs of indexes and one of said scales, where if a pair of indexes are visibly positioned the other pair of indexes are moved to a position which is not visible to the operator.

Figure 39:
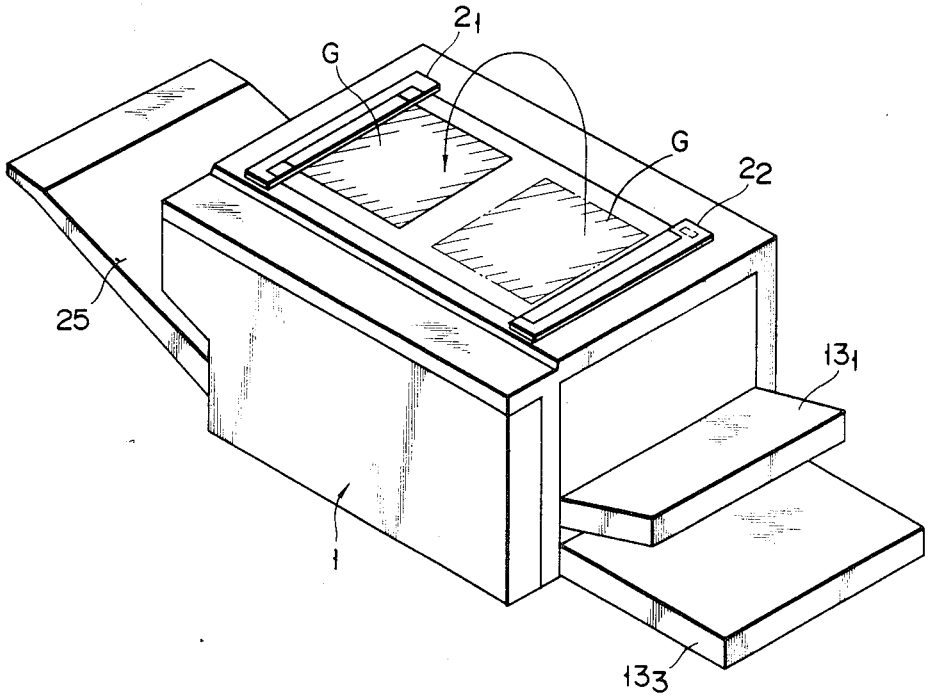
Figure 40:
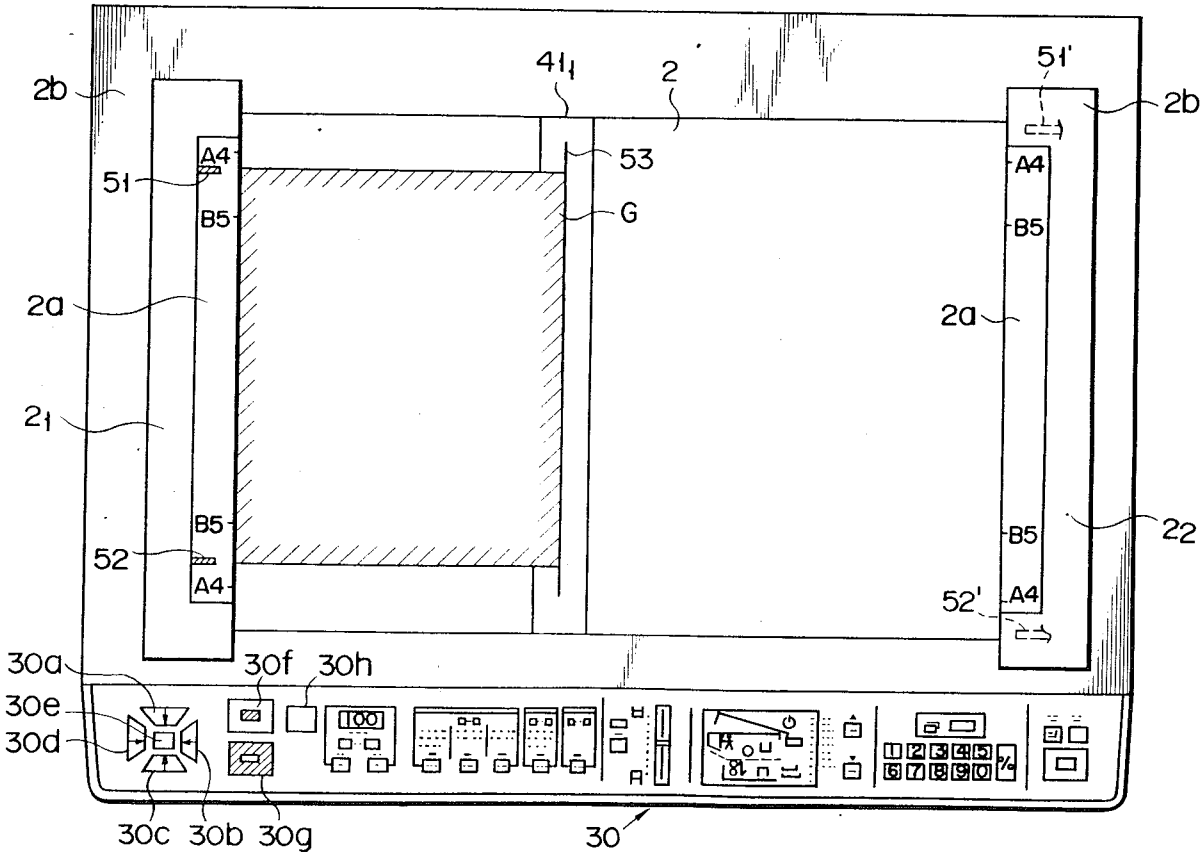
Figure 41:
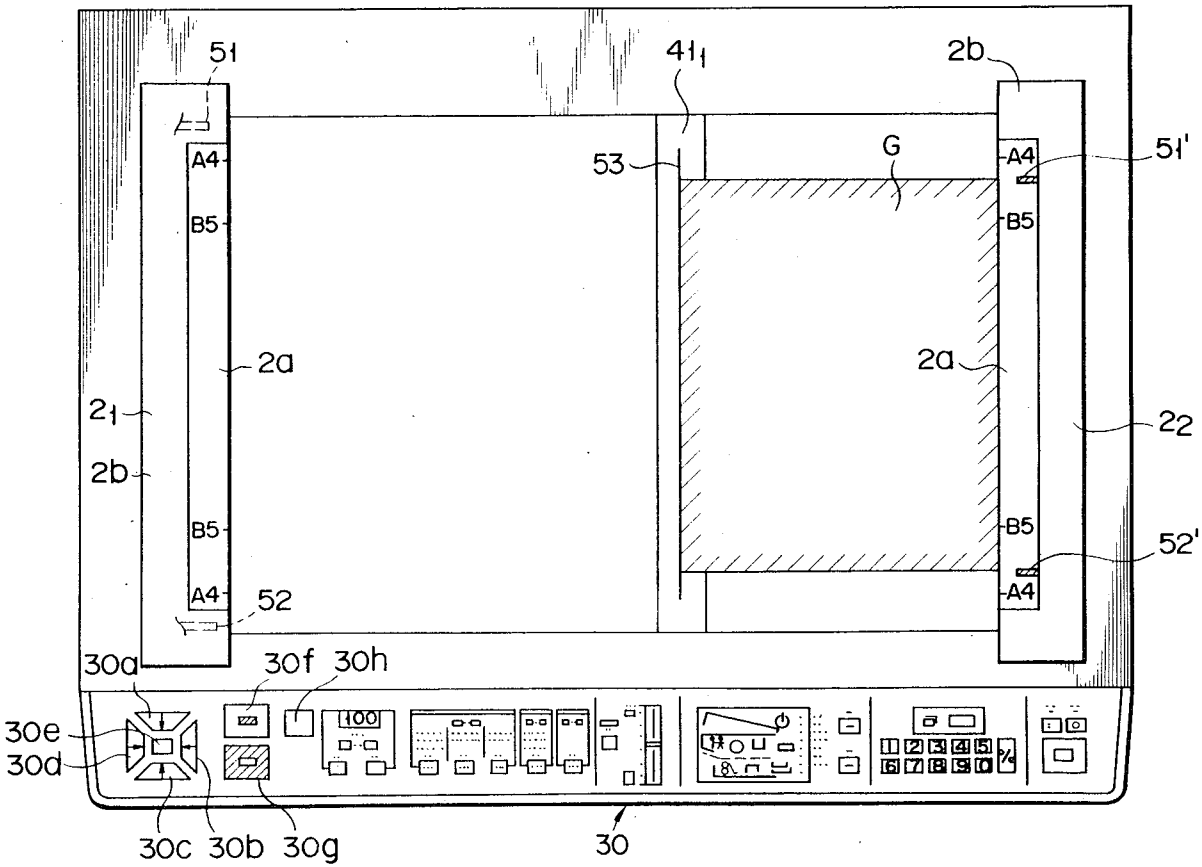

Said original table 2 can indicate the area that can be used for copying in response to the paper size that has been specified. Thus, if, for example, the paper size that has been specified by sheet specifying key $30_4$ is (Px, Py) and the magnifying power that has been specified by magnifying power specifying key $30_5$ and $30_7$ is K, the area that can be used for copying will be expressed as (x, y), where $x=Px/K$ and $y-Py/K$. For the area (x, y), the limits in x direction are defined, as shown in FIGS. 39, 40 and 41, either by indexes 51, 52 which are found on the lower surface of fixed scale $2_1$ at the left edge of original table 2 or by indexes 51', 52' which are found on the lower surface of fixed scale $2_2$ at the right edge of original table 2, whereas the limits in y direction are defined by scale 53 which is found on the upper surface of said first carriage $41_1$.

Each of said fixed scale plates $2_1$ and $2_2$ is consisted of a transparent section *2a* and a white opaque section *2b*. The width of said transparent section *2a* is equal to the maximum width Xs that can be used for copying (visible position). Therefore, if index pair 51, 52, or 51', 52', go beyond the maximum width Xs, they go under opaque section *2b* and hence become invisible to the operator. In other words, the indexes go to invisible positions.

Figure 42:
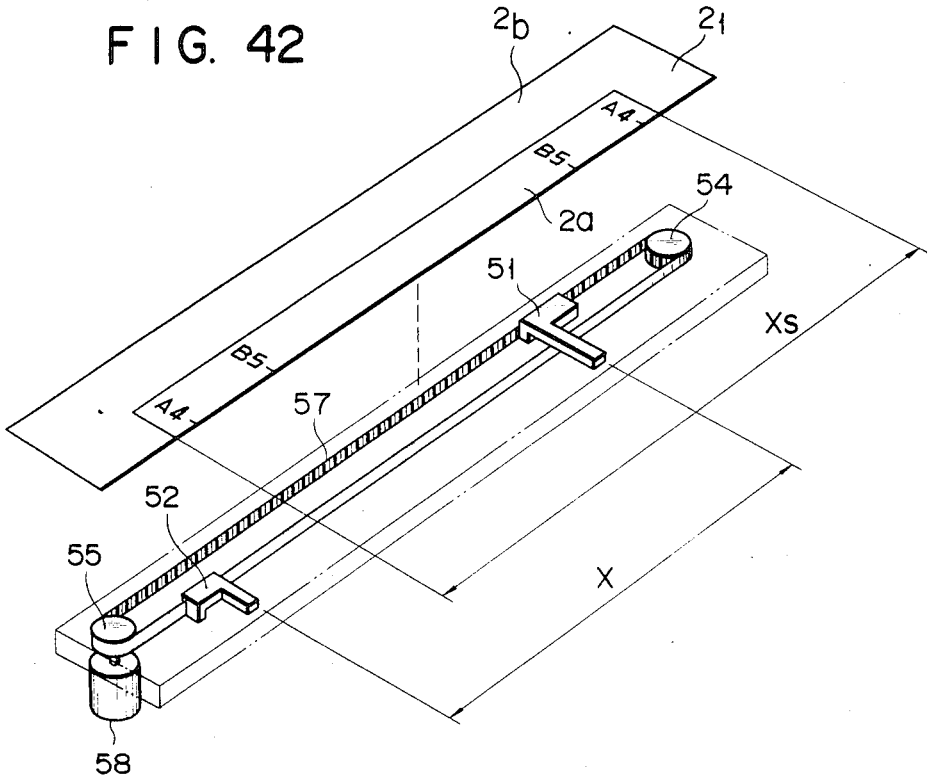
Figure 43:
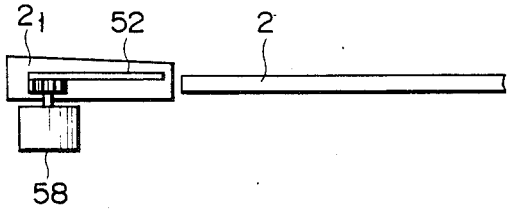

As shown in FIGS. 42 and 43, said indexes 51, 52 are provided on belt 57 which functionally connects pulley 54, 55. Since said pulley 55 is rotatively driven by motor 58 and the latter is operated at a rate which is a function of the paper size and the magnifying power that have been selected, the distance between indexes 51 and 52 is adjustable. As described earlier, the distance defined by said indexes 51 and 52 is equal to the longitudinal length of the area that can be used for copying and indexes 51, 52 can move beyond the maximum width Xs that can be used for copying. Said indexes 51' and 52' are, like said indexes 51 and 52, driven by motor 58'.

With the configuration of an image forming apparatus as described above, when erasure mode specifying key 30*h* is depressed by the operator, main processor group 71 defines an erasing action and set the apparatus into the erasure mode. Then main processor group 71 puts motor 58' in motion to move indexes 51', 52' and define the area that can be used for copying (longitudinal length: width in x direction) in response to the specified paper size. Main processor group 71 also put motor 33 in motion to move the first carriage $41_1$ to define the area that can be used for copying (lateral width with fixed scale plate $2_2$: width in y direction) which corresponds to the paper size specified by scale 53.

At this stage, main processor group 71 puts motor 58 in motion to move indexes 51, 52 out of the span Xs. Indexes 51, 52 go under opaque section *2b* of fixed scale plate $2_1$ and become invisible to the operator. Thus the operator may quickly recognize if he has positioned an original incorrectly.

The operator now can correctly position the original, as shown in FIG. 40, to the side of fixed scale plate $2_2$ with the side to be copied of the original facing downward. Then the erasure area is specified as described above and erasure area specifying keys 30*f*, 30*g* are depressed. Main processor group 71 then detects the end of the specifying procedures of the erasure area and set the apparatus to the copy mode. Now main processor group 71 puts motor 58 in motion to move indexes 51, 52 and define the area to be used for copying (longitudinal length: length in x direction) which corresponds to the specified paper size. At this stage, main processor group 71 also put motor 33 in motion to move the first carriage $41_1$ and define the area to be used for copying (lateral width with fixed scale plate $2_1$: width in y direction) which corresponds to the paper size specified by scale 53.

Then main processor group 71 put motor 58' in motion to move indexes 51', 52' out of the span Xs. Indexes 51', 52' go under opaque section *2b* of fixed scale plate $2_1$ and become invisible to the operator. Thus the operator may be able to quickly recognize if he has positioned an original incorrectly.

Operator is now able to correctly position the original, as shown in FIG. 41 through the condition shown in FIG. 39, to the side of fixed scale plate $2_1$ with the side to be copied of the original facing downward. If copying key $30_1$ is depressed, an erasing and copying operation is carried out as described earlier.

With this embodiment, therefore, the operator can recognize from the use of indexes 51', 52' or indexes 51', 52' and scale 53 to which fixed scale plate he should position the original G particularly when he specifies a trimming position. Also operational errors can be reduced to minimum since, of the indexes 51', 52', 51, 52 provided on both sides of the original table, only those which are used for a copying operation are visible to the operator and the rest are made invisible.

What is claimed is:

1. An image forming apparatus with a plurality of colors, said apparatus comprising:

an original table for placing thereon an original which possesses at least a first color and a second color;

original scanning means for optically scanning an original placed on said original table, said means having an optical system to feed the image reflecting light coming from the original into a given light path;

color component detection means for transmitting electric signals corresponding to said first and second colors in response to the image reflecting light, said means being movably provided on said light path on which said image reflecting light coming from said optical system of said original scanning means passes;

original color identifying means for identifying different color areas from the electric signals for said first and second colors transmitted from said color component detection means and for storing the color and positional data for the first and second colors in different color areas;

image forming means for forming an image of given colors of the original on an image forming medium by using said image reflecting light coming from said optical system of said original scanning means and by selectively driving a first and a second developing units which correspond to said first and second colors respectively;

image erasing means for selectively erasing an image to be formed by said image forming means;

image forming medium return means for selectively returning said image forming medium to said image forming means after formation of an image by said image forming means;

first control means for producing a first control signal to drive said original scanning means and said color component detection means for a given number of times prior to actual formation of an image;

second control means for reading out, at the time of the first image forming operation, said first color data that have been stored in said original color identifying means to send them to said first developing unit of said image forming means as drive signals and said second positional data which correspond to said second color data to send them to said image erasing means as erasure data and for producing a second control signal to said image forming medium return means as an instruction for a return operation; and third control means for reading out, at the time of the second image forming operation, said second color data that have been stored in said original color identifying means to send them to said second developing unit of said image forming means and said first positional data which correspond to said first color data to send them to said image erasing means as erasure signals.

2. An image forming apparatus with a plurality of colors as claimed in claim 1, wherein said original color detection means comprises a CCD and a plurality of color filters.

* * * * *